US006443666B1

(12) United States Patent
Smith

(10) Patent No.: US 6,443,666 B1
(45) Date of Patent: Sep. 3, 2002

(54) REINFORCED CONCRETE PANEL AND METHOD OF MANUFACTURE

(76) Inventor: William H. Smith, 105 Stable Rd., Patterson, LA (US) 70392

( * ) Notice: Subject to any disclaimer, the term of this patent is extended or adjusted under 35 U.S.C. 154(b) by 0 days.

(21) Appl. No.: 09/396,466

(22) Filed: Sep. 15, 1999

Related U.S. Application Data

(60) Provisional application No. 60/100,524, filed on Sep. 16, 1998.

(51) Int. Cl.[7] ..... E04C 5/08; E02D 5/10

(52) U.S. Cl. ..... 405/286; 405/275; 52/223.6; 52/405.1; 52/405.3

(58) Field of Search ..... 405/275, 274, 405/284, 286; 52/223.6, 424, 601, 427, 69, 223.14, 405.1, 405.3

(56) References Cited

U.S. PATENT DOCUMENTS

| | | | | | |
|---|---|---|---|---|---|
| 950,085 | A | * | 2/1910 | West | 52/223.6 |
| 1,452,107 | A | * | 4/1923 | Baumhover | 52/289 |
| 1,510,224 | A | * | 9/1924 | Hicks | 52/405.3 |
| 2,338,246 | A | * | 1/1944 | Hoge | 52/601 |
| 2,477,381 | A | * | 7/1949 | Lewis | 52/275 |
| 2,701,904 | A | * | 2/1955 | Roensch | 52/601 |
| 3,760,540 | A | * | 9/1973 | Latoria et al. | 52/601 |
| 3,872,636 | A | * | 3/1975 | Nicosia | 52/364 |
| 4,432,175 | A | * | 2/1984 | Smith | 52/223.6 |
| 4,472,919 | A | * | 9/1984 | Nourse | 52/601 |
| 4,554,124 | A | * | 11/1985 | Sudrabin | 52/601 |
| 4,594,833 | A | * | 6/1986 | Mieyal | 52/601 |
| 4,611,450 | A | * | 9/1986 | Chen | 52/309.4 |
| 4,642,960 | A | * | 2/1987 | Wallover, III | 52/390 |
| 5,056,242 | A | * | 10/1991 | Miotti | 405/287 |
| 5,129,203 | A | * | 7/1992 | Romero | 52/309.11 |
| 5,190,413 | A | * | 3/1993 | Carey | 405/286 |
| 5,268,540 | A | * | 12/1993 | Rex | 181/210 |
| 5,335,472 | A | * | 8/1994 | Phillips | 52/743 |
| 5,522,194 | A | * | 6/1996 | Graulich | 52/405.1 |
| 5,546,708 | A | * | 8/1996 | Efstratis et al. | 52/36.2 |
| 5,800,095 | A | * | 9/1998 | Egan | 405/284 |
| 5,802,793 | A | * | 9/1998 | DeVore, Jr. | 52/427 |
| 5,860,268 | A | * | 1/1999 | McWilliams | 52/601 |
| 5,862,639 | A | * | 1/1999 | Abou-Rached | 52/223.6 |
| 5,974,762 | A | * | 11/1999 | Rodgers | 52/742.14 |
| 6,101,779 | A | * | 8/2000 | Davenport | 52/223.6 |
| 6,167,671 | B1 | * | 1/2002 | Wilson | 52/426 |

* cited by examiner

*Primary Examiner*—Robert E. Pezzuto
*Assistant Examiner*—Alexandra K. Pechhold
(74) *Attorney, Agent, or Firm*—Burns, Doane, Swecker & Mathis, LLP

(57) ABSTRACT

A reinforced concrete panel is formed by embedding a stretched steel chain link mesh unit within concrete. The panel can be used to form a building or a flood dyke, or an earth reinforcing wall. The earth reinforcing wall is formed by digging a trench in the soil. Vertical posts are positioned in the trench, the posts spaced apart by a distance corresponding to a width of a panel. The panels are lowered between adjacent pairs of posts, and the edges of each panel slide within grooves formed in the posts. Finally, the trench is filled with concrete to encase the panels and posts.

15 Claims, 22 Drawing Sheets

REINFORCED CONCRETE PANEL AND METHOD OF MANUFACTURE

RELATED INVENTION

This invention is related to the disclosure of U.S. Provisional Application Serial No. 60/100,524, filed Sep. 16, 1998.

BACKGROUND OF THE INVENTION

This invention relates to the manufacture of a reinforced concrete panel, and installation of a uniquely prestressed, high strength/to weight modular reinforced concrete wall from the panels which is rapid to manufacture and install. The panel is primarily used for the construction of buildings or the reinforcement of soil or the deflection of flood waters.

Floodwaters annually take a toll on life, health, property, and well being in the United States of America. As human population values continue to increase in areas known or unappreciated as being part of a flood plane, injuries of the same will continue. Current methods of flood water protection in the form of property elevation, levee building, or particularly, wall construction are often difficult to initiate when implementation or maintenance costs are taken into account. These costs are often staggering due to the large amount of equipment, machinery, materials, labor and time involved to cause a project of this type to come to its fruition. This is especially true if there is a short time frame allotted for the construction or installation of the same to circumvent flooding which although may not be common for a particular geographical area, it has been predicted to be in imminent danger of such an occurrence happening there as a result of actions by man, nature, or a combination of both.

SUMMARY OF THE INVENTION

One aspect of the invention relates to a reinforced structural panel which comprises a concrete body having a pretensioned metallic chain link unit embedded therein and extending across a substantial portion of the concrete body. The panel can be used to construct a building or a soil retaining wall, or a flood dyke for example.

Another aspect of the invention relates to an apparatus for forming a reinforced structural concrete panel. The apparatus comprises a frame which includes side walls and a backing wall forming a cavity. The frame is pivotable about a horizontal axis for being pivoted between horizontal and vertical orientations. The cavity is upwardly open when the frame is in a horizontal orientation and is adapted to receive poured concrete for forming a concrete panel. The backing wall is adapted to support a chain link unit and a concrete body when the frame is in a horizontal orientation. At least two of the side walls of the frame have holes formed therethrough for enabling wires to pass from the cavity to the exterior to hold a chain link unit in a pretensioned state. The stretching mechanism is removably mounted on the frame when the frame is in a horizontal orientation. The stretching mechanism includes tensioning members disposed in the cavity and adapted to engage a chain link unit. The stretching mechanism also includes a displacement device for displacing the tensioning members relative to the frame for pretensioning a chain link unit prior to the pouring of concrete into the cavity.

Another aspect of the invention relates to a method of forming a reinforced structural concrete panel comprising the steps of:

A. positioning a metallic chain link unit in a cavity formed by a frame;

B. applying tensioning forces to the chain link unit for stretching and pretensioning the chain link unit;

C. pouring concrete into the cavity while maintaining the chain link unit in a pretensioned state, to embed the chain link unit in the concrete;

D. allowing the concrete to harden; and

E. releasing the tensioning forces from the chain link unit.

Another aspect of the invention relates to a method of forming an earth retaining wall comprising the steps of:

A. digging a trench in the ground;

B. anchoring panel-retaining members in the trench;

C. lowering reinforced concrete panels into the trench between respective pairs of panel-retaining members such that opposite vertical edges of each panel become connected to the respective pair of panel-retaining members by a tongue-and-socket coupling; and D. pouring concrete into the trench to embed the panels and the panel-retaining members therein.

The floodwater deflection wall manufacturing and installation system comprise various components, and methodologies. During the manufacturing phase various platforms, forms, molds, tools, materials, and techniques are utilized in the production of panels and posts.

A skeletal frame composed of rebar is welded. This framework is suspended within the post casting mold. The rebar extends outside of the posts cast bottom surface plane, unless this is not necessary such as being incorporated into a cast post which is to be pile driven.

A marriage band is shipped to the job site with each post. This is a welded unit utilizing rebar its function is described later in the installation process description.

Outer casting border mold frames are clamped to a tilt up panel casting platform. A galvanized woven wire mesh with is placed in the form. This woven wire is more commonly known as chain link fence fabric. Rebar is inserted into the end sections which run at the top and bottom of the panel left to right within the panel in relationship to an upright panel. The same type of rebar components may be inserted in the same manner within the mesh at intervals proceeding down the panel's vertical plane. The woven wire mesh is then pulled in tension at bottom panel station until the mesh has at this point become suspended under tension. This will give the reinforcement mediums an added element in maintaining structural strength. The individual uninterrupted wire strands which make up the woven wire proceed from left to right. They have 45 degree bends up and down as they traverse to the right. This provides the panel's concrete several reinforcement benefits. The wire is not at only one uniform plane, in reference to x, y, and z coordinates it has several lines of reinforcement amplification. It being prestressed with the uninterrupted wire run proceeding from left to right in relationship to an upright panel allows the hardened concrete a degree of pressure resistance with flexibility, yet will retain its binary compounds which are in the form of portland cement and aggregates in various embodiments from falling out of a state of cohesion. The incorporation rebar into this weave provides an additional redundant static reinforcement. In conjunction with these, rebar is laid on a vertical plane in relationship to an erected panel at the left and right edges, center, and left and right ⅓rd measurements on top of the woven wire mesh. This is a redundant factor which is used for additional reinforcement in a positive fashion. The concrete is now poured, and the surface finished smoothly.

A quarter radius void bar is placed at the left, and right side of the forms in relationship to an upright panel in the wet concrete. These void bars run from the top to the bottom of the mold at their respective placements. The purpose of these two voids will be described at the installation process description once the panel has cured the forms and molds are stripped, tie wires cut, the tilt up casting platform elevated to an upright position, the panel slides down on the anchor/panel resting stop, a forklift picks it up and it is loaded out to the job site.

At the installation location shot points and grades are established. At predetermined intervals holes are bored to a predetermined depth below established grade. Upon completion of the weekly production quota of hole, a chain trencher commonly known as a "Ditch witch" with a cutting certain width of will trench a line center of the hole lines to a predetermined depth below grade. Upon completion of the trenching phase adjustable site leveled prepostioning post holding template rack stands are laid out and adjusted. Then the prepositioning post holding template rack is lowered onto the stands, adjusted, and clamped down in place. The posts are then lowered in their respective holes arid held at a predetermined height by a height retention stand, unless they are pile driven into the ground. The rebar which protrudes beyond the bottom perimeter of the "H" shaped post is pushed down below surface of the bottom of the bore holes. The marriage band is then lowered to a point that it encompasses the bottom length of the "H" post. Cement is poured downhole to within close proximity of the bottom of the panel holding slot in the "H" post. The rebar protruding from the post to below the borehole subsurface and the marriage band serves as a reinforcement measure to bind the precast post in place with the newly poured concrete.

Upon the curing of the newly poured concrete downhole, the post holding templates will be removed.

Wood forms will be inserted into the slots of the "H" posts and rest on the anchoring pour which was previously done. A second pour of concrete will be initiated down hole on one side of the "H" post to the ground surface. The concrete will dry, and the forms will be removed.

The panels will be slid down the slots on the sides of the "H" post. The fig. panels will have grout pumped down the quarter radius void cast in the panel and resting within the confines of the slots of the cast posts. This will provide a static surface movement area between the "H" post, and the panel. Upon completion of this phase grout, or cement will be pumped down the void between concrete panel and the trench walls subsurface. The remainder of the bore hole void on the side of the, "H" post will be filled with grout.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Reinforced Panel

Figure 1A:
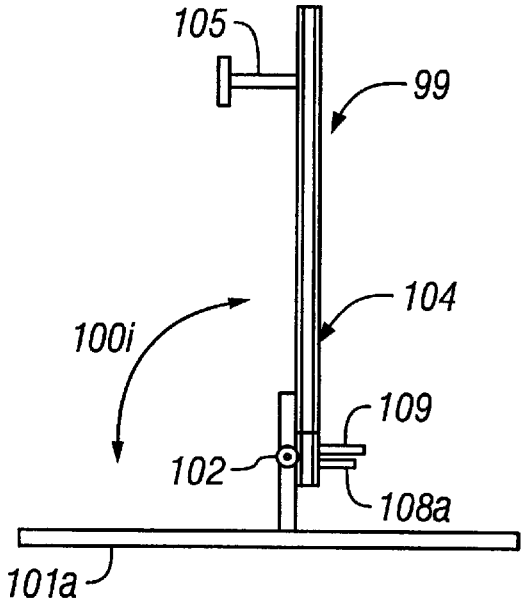
FIG. 1A is a side elevational view of a panel-forming mechanism according to the present invention, with a frame thereof in a vertical orientation.
Figure 1B:
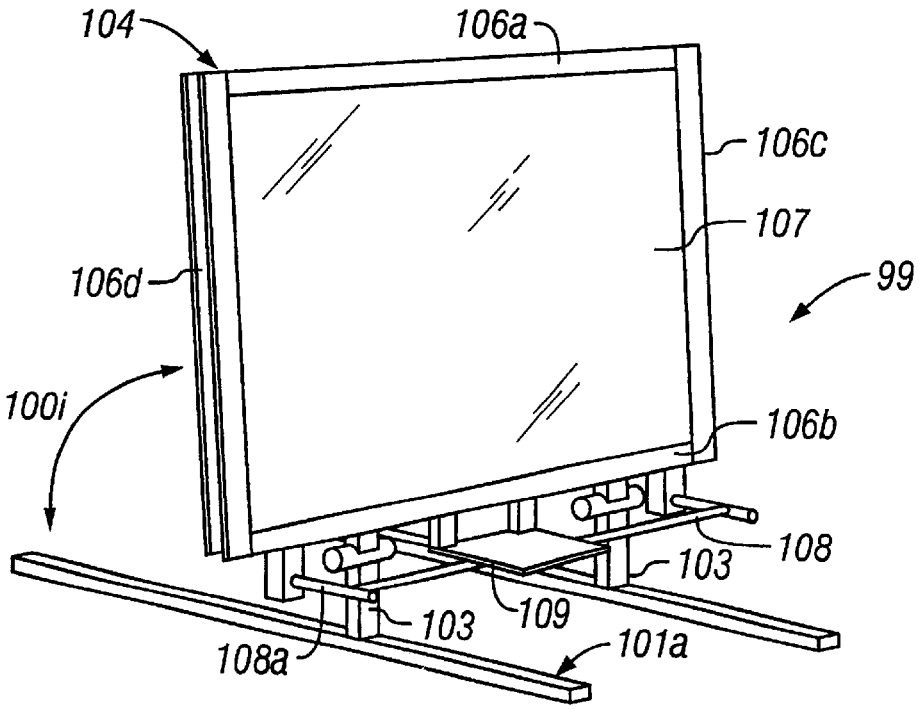
FIG. 1B is a front perspective view of FIG. 1A.

Referring now to the drawings, particularly to FIGS. 1A–3, there can be seen a rectangular steel box tubing which serves as a stable footing 101*a* for a tilt up casting platform 99. A steel barrel hinge 102 allows the tilt up casting platform to be tilted up in the direction 100i. The hinge 102 is welded to portions of square steel box tubing that is welded to the bottom of a steel frame 104 of the tilt up casting platform 99 in which other items are either welded to or attached to. A stationary leg 105 made from steel box tubing is secured to the frame 104. When the tilt up casting platform 99 is rotated to a horizontal state, the leg 105 supports the weight of the upper half of the unit. The frame 104 includes a top I-beam section 106*a*, a bottom I-beam section 106*b*, and two side I-beam sections 106*c*, 106*d* interconnecting the top and bottom sections in any suitable manner, e.g. by welds or clamps. A steel casting deck 107 is welded to the frame 104. A wire retention bar 108 passes beneath an anchor/panel resting stop 109 which has been welded to the frame 104. The bar 108 is affixed to fingers 108*a* that are affixed to the frame 104.

Figure 2:
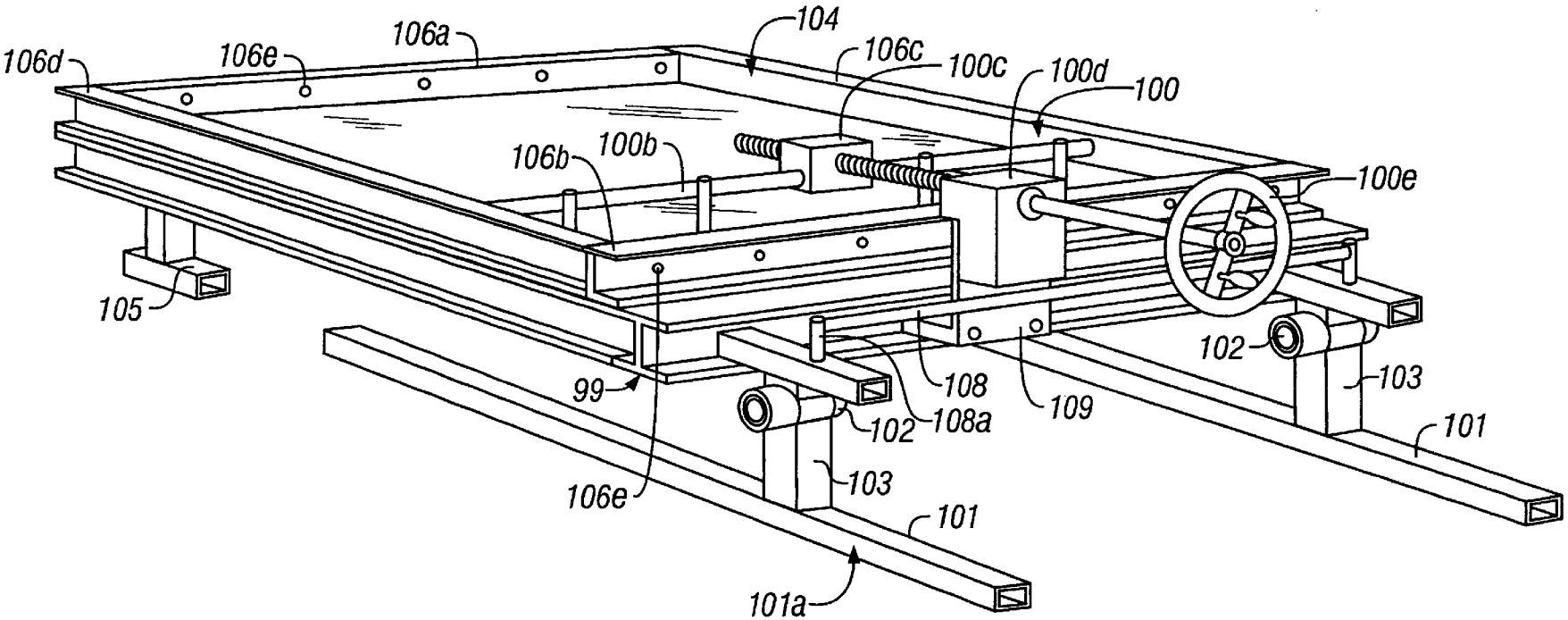
FIG. 2 is a top perspective view of the apparatus depicted in FIG. 1, when a frame thereof is in a horizontal orientation, and a stretching mechanism is mounted thereof.

Referring to FIG. 2, the tilt up casting platform 99 is shown in a horizontal state, and a chain link tensioning apparatus 100 is in place resting on the anchor/panel resting stop 109.

Figure 3A:
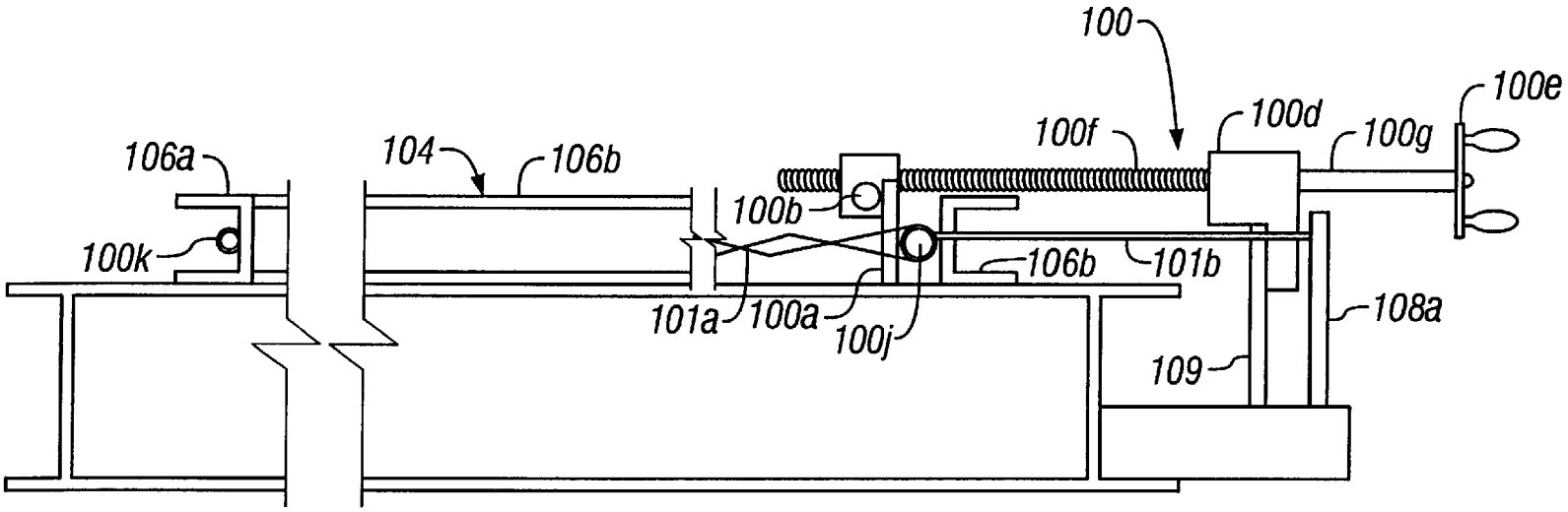
FIG. 3A is a side elevational view of the apparatus depicted in FIG. 2.
Figure 3B:
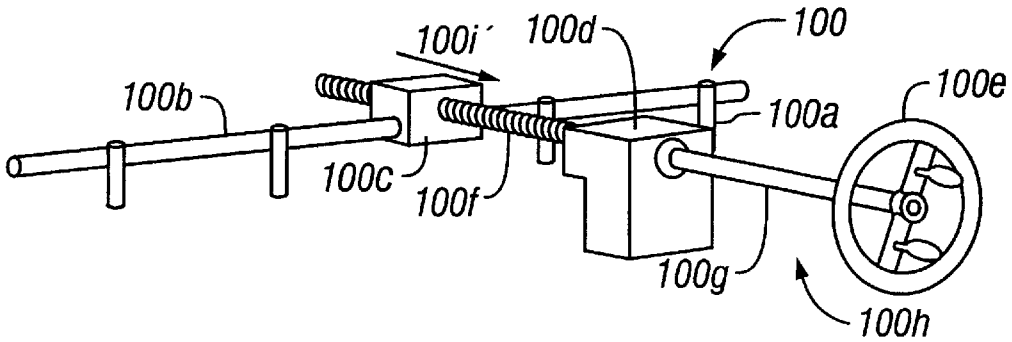
FIG. 3B is a perspective view of the stretching mechanism.

Referring to FIGS. 3A and 3B, the chain link stretching apparatus 100 comprises a hand wheel 100*e* attached to a rod 100*g* which passes through a machined block 100*d* and includes a threaded section 100*f*. The section 100*f* passes through a threaded hole of a machined steel block 100*c*. When 100*e* is turned in direction 100*h*, the block 100*c* and its direct associated parts namely, a bar 100*b* and legs 100*a*, are drawn in direction 100*i*'. The block 100*d* is anchored upon stop 109 and has resistance provided by a tension bar 100*j* held by a lower end of a conventional woven steel chain link mesh 101*a*, an upper end of which is attached to a portable wire retention bar 100*k* situated above, and held snug by, the outer surface of the top section 106*a* of frame 104 (see FIG. 3A).

Referring to FIG. 3A, the chain link tensioning apparatus 100 is set upon the anchor/panel resting stop 109 and the deck 107. The fingers 100*a*, which are rigid steel fingers, rest on the surface of the deck 107 and pull against the tension bar 100*j*. That bar is secured by tie wires 101*b* which pass through respective holes 106 formed in the bottom section 100*b* of the frame 109. The tie wires 101*b* extend to the wire retention bar 108 on which they are wrapped (see FIG. 4).

In the same fashion, at the top of the mold this step is repeated. That is, the bar 100*k* is held tight against the outer face of frame section 106*a* by the tension exerted from the woven chain link mesh 101*a* held in place by the tension bar 100j' which has been inserted in the end runs of the wire weave, as that same force is transferred to the wires 101*b*' that pass through holes 106e' formed in the frame top section 106*a*.

Figure 5A:
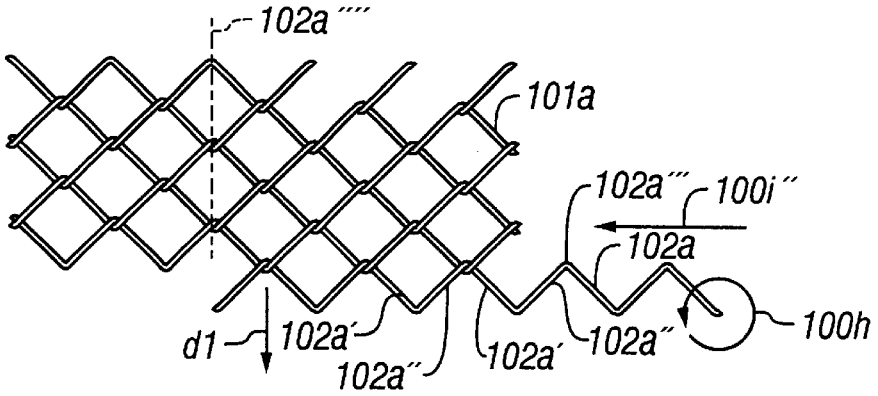
FIG. 5A (Prior Art)
FIG. 5A is a top plan view of a section of a conventional chain link unit.

In reference to FIG. 5A, a section of the conventional chain link mesh 101*a* is presented. When an independent strand of wire 102*a* of the mesh 101*a* is twisted in the direction 100*h*, the independent strand of wire 102*a* will weave into the matrix of the mesh 101*a* as it follows the direction 100*i*", to form a twist joint. Subsequently, if a twist in a direction reversely of 100*h* is initiated, the strand 102*a* will travel in the reverse direction, and eventually disengage itself from the whole mesh. It is in this conventional fashion that the individual wire strand members are woven to make up the matrix of a section of woven chain link mesh.

Each strand 102*a* is generally zig-zag shaped and comprises parallel first segments 102*a* ' and parallel second segments 102*a*". the first segments 102*a*' are oriented substantially perpendicular to the second segments 102*a*". Each first segment forms an apex 102*a*"' with an adjacent second segment. The strands are arranged in side-by-side relationship, with the apexes of each strand interlinked with respective apexes of an adjacent strand. The interlinked apexes form parallel rows 102*a*"" of interlinked apexes, the rows extending perpendicular to the strands. The mesh unit is prestressed in a direction d1 that is perpendicular to the strands and parallel to the rows 102*a*"" of interlinked apexes.

Figure 4:
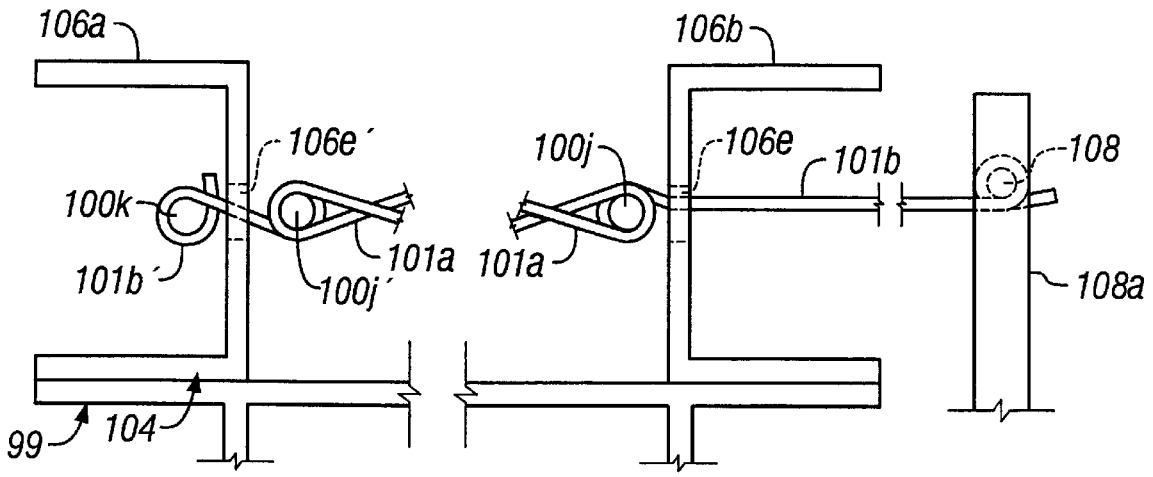
FIG. 4 is a side elevational view depicting a chain link unit being pretensioned in the frame.
Figure 5B:
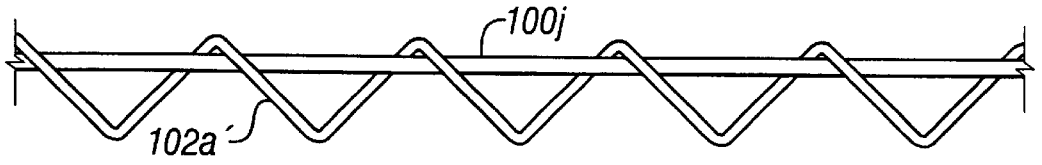
FIG. 5B (Prior Art)
FIG. 5B is a top plan view of an edge section of the conventional chain link unit.

In FIG. 5B, there is shown a fragmented singular wire strand 102*a* with a fragmented portion of the tension bar 100*j* inserted within the weave. In FIG. 4, this bar 100*j*, as well as bar 100*j*', is under tension.

Figure 6:
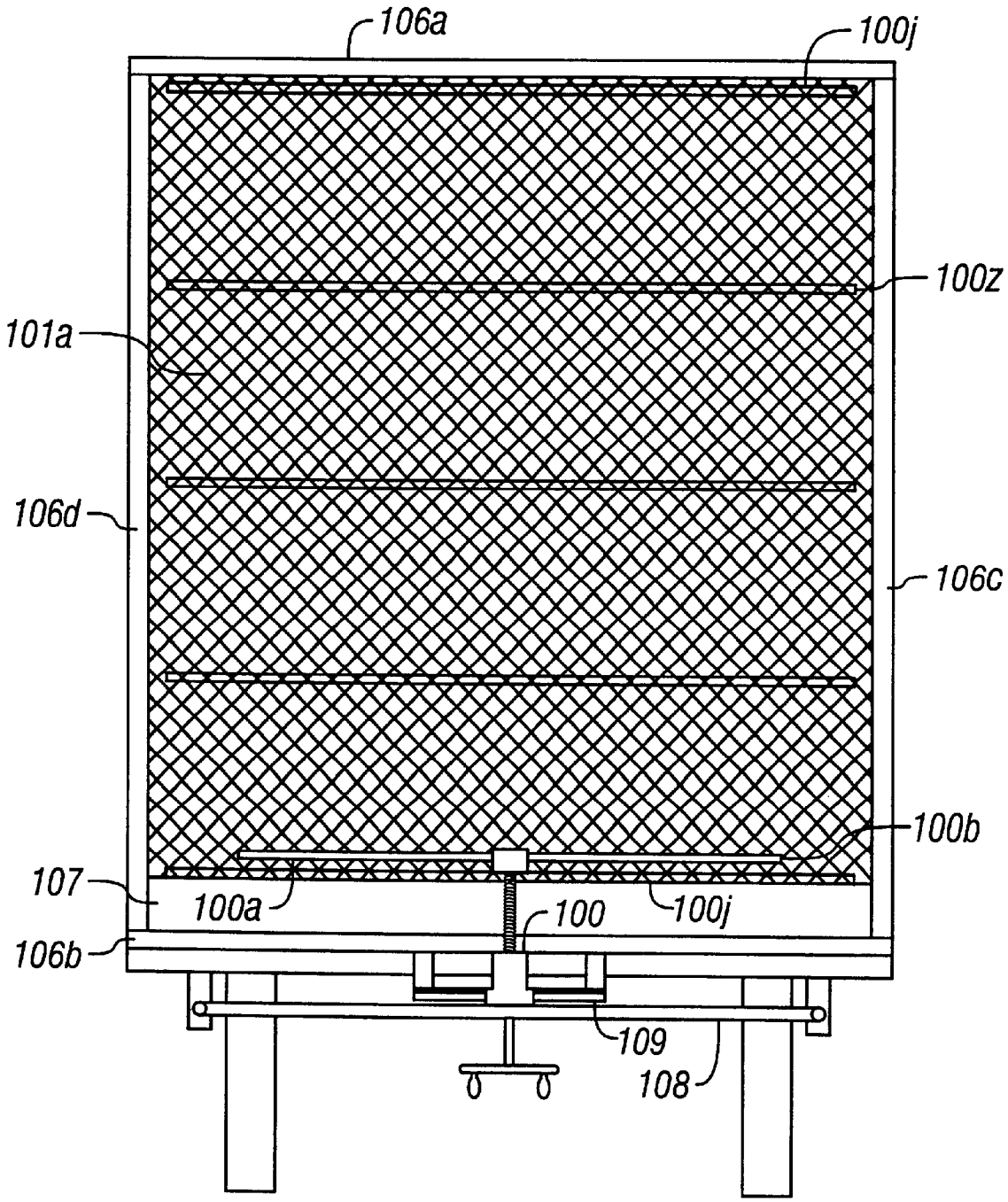
FIG. 6 is a top plan view of the unit depicted in FIG. 2 as the stretching mechanism is pretensioning a chain link unit disposed in a cavity of the frame.

In reference to FIG. 6, three additional pieces of rebar designated as 100*z* are provided in the section of chain link. These are redundant rebars that are not involved in the stretching or tensioning acts, but rather serve as redundant concrete reinforcement as will become apparent. In FIG. 6, the stretching apparatus 100 is in the process of stretching the mesh 101*a*.

Figure 7:
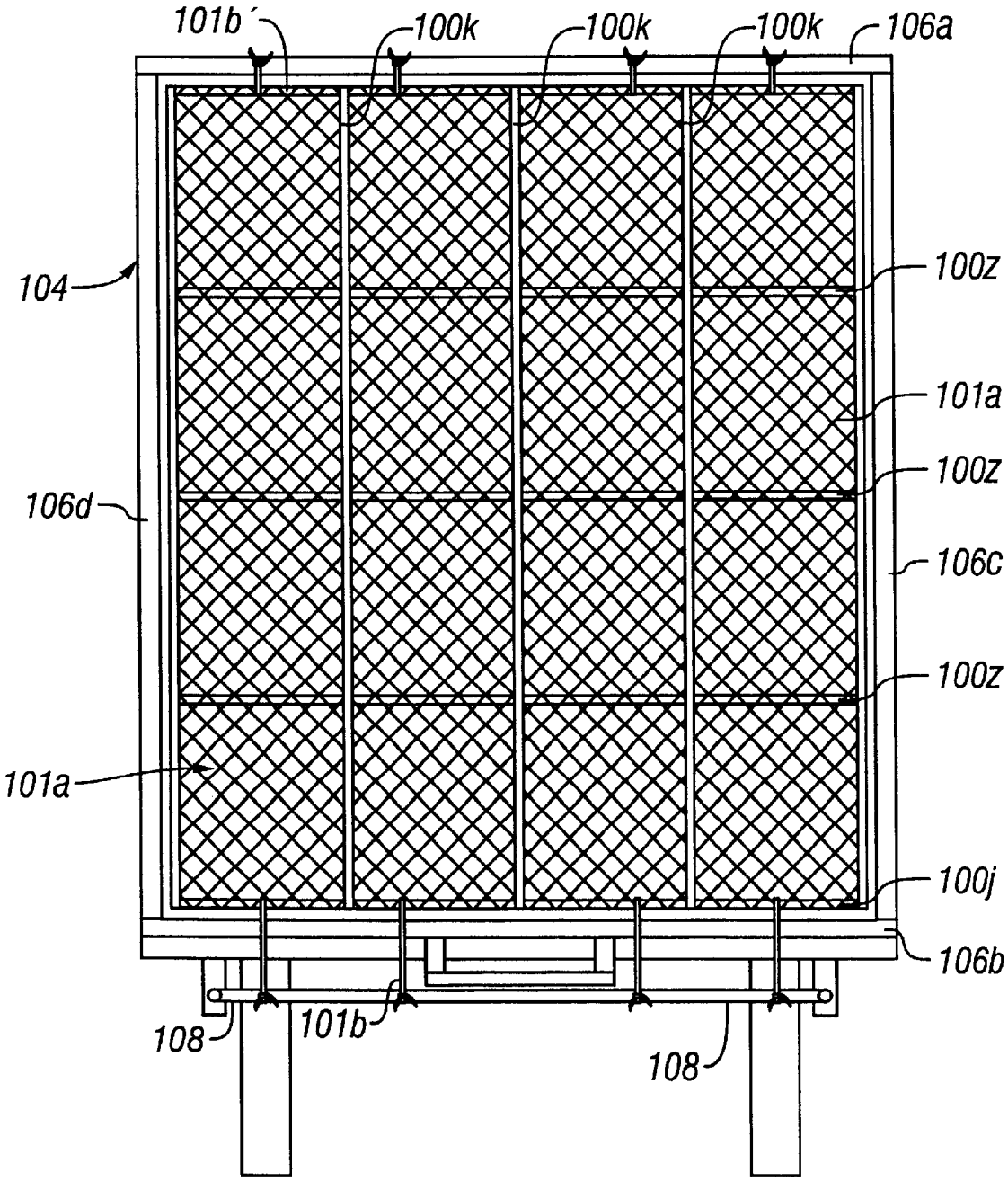
FIG. 7 is a view similar to FIG. 6 after the chain link unit has been fully pretensioned, and the stretching mechanism has been removed.

In reviewing FIG. 7, the chain link mesh 101*a* has been stretched to within close proximity of frame section 100*b*. Redundant rebars 100*x* have been laid on top of the mesh, and are not inserted into the chain link mesh. The stretching apparatus 100 has been removed since it has completed its use. The tie wires 101*b* have been wrapped around the bar 108 to cause the chain link mesh 101*a* to remain in tension, so that the concrete can be poured within the confines of the frame 104, as shown in FIG. 8.

Figure 8:
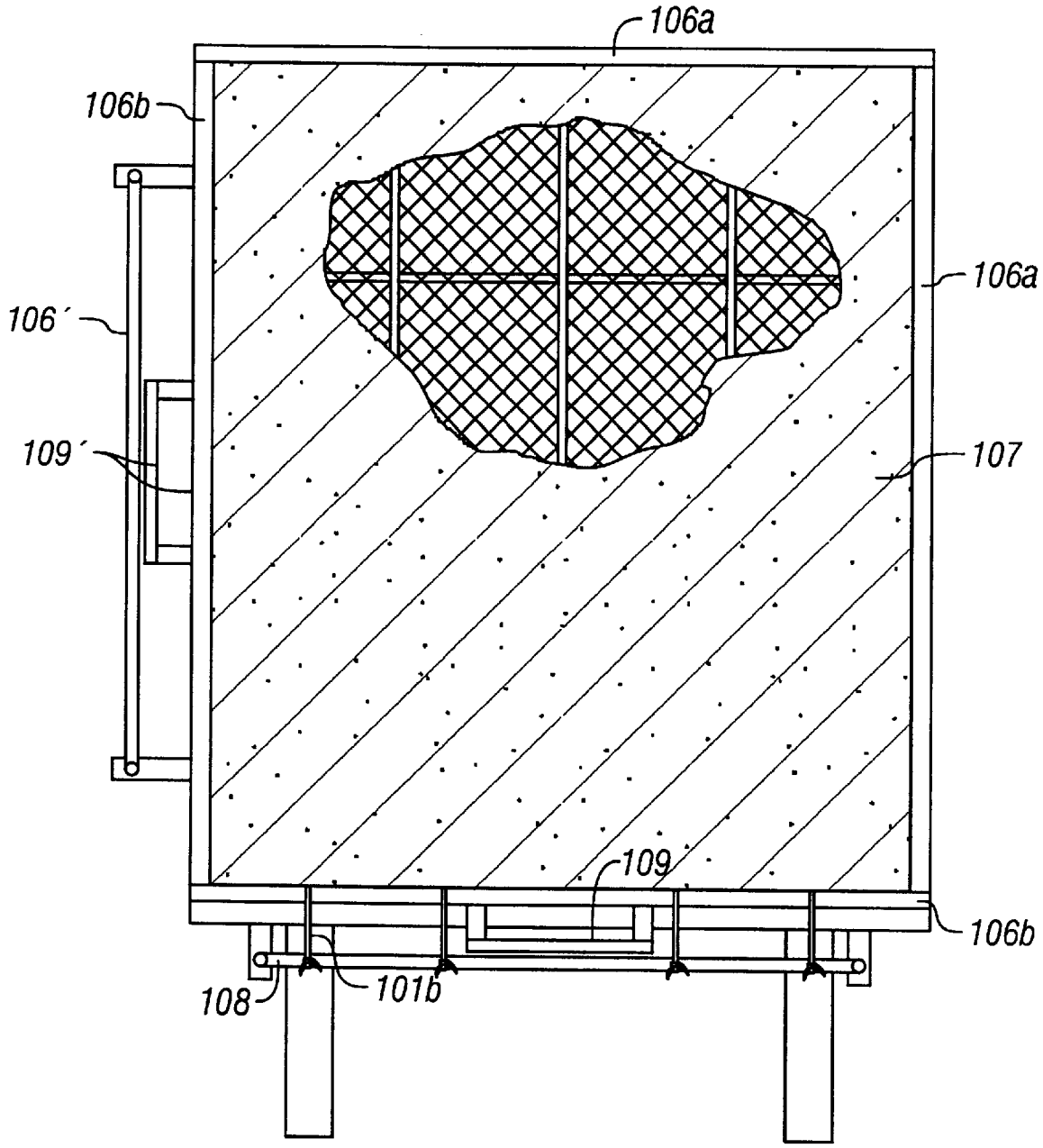
FIG. 8 is a top plan view of the frame after concrete has been poured into the cavity to embed a pretensioned chain link unit therein, with a portion of the concrete broken away to reveal the chain link unit.

In reference to FIG. 8 an optional additional wire retention bar 108' is shown on the left hand side of the tilt up casting platform. There is an additional anchor/panel resting stop 109' and that in place of original frame sections 106*d*, and 106*c*, additional frame sections identical to frame sections 106*b*, and 106*a* have been provided. The purpose of this is so that a second layer of chain link mesh, if required for some purpose, may be installed in the same fashion as the steps depicted in FIG. 6, and in FIG. 7. In this redundant application, instead of the direction of the weave going from left to right at the base of the mold, it would proceed left to right in relationship to the side of the mold. The tilt up casting platform would still tilt up in the same direction as shown in FIG. 1A.

Figure 9A:
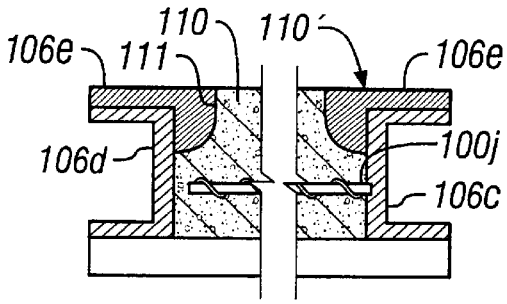
FIG. 9A is a sectional view taken through the frame and concrete panel.
Figure 9B:
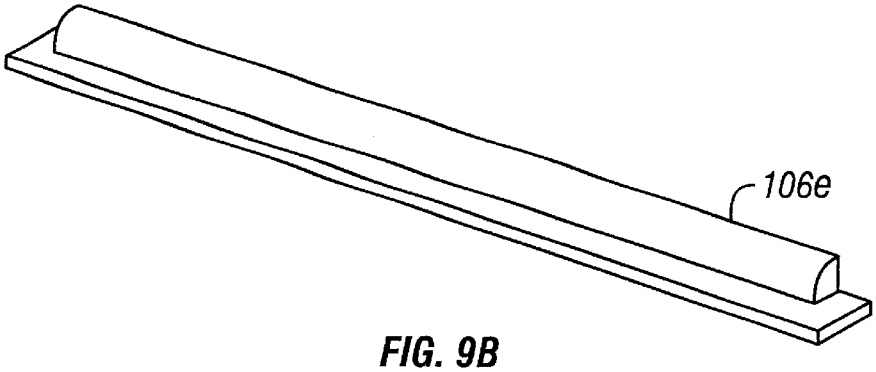
FIG. 9B is a perspective view of members inserted into the cavity to form quarter-circle recesses in the concrete panel.
Figure 10:
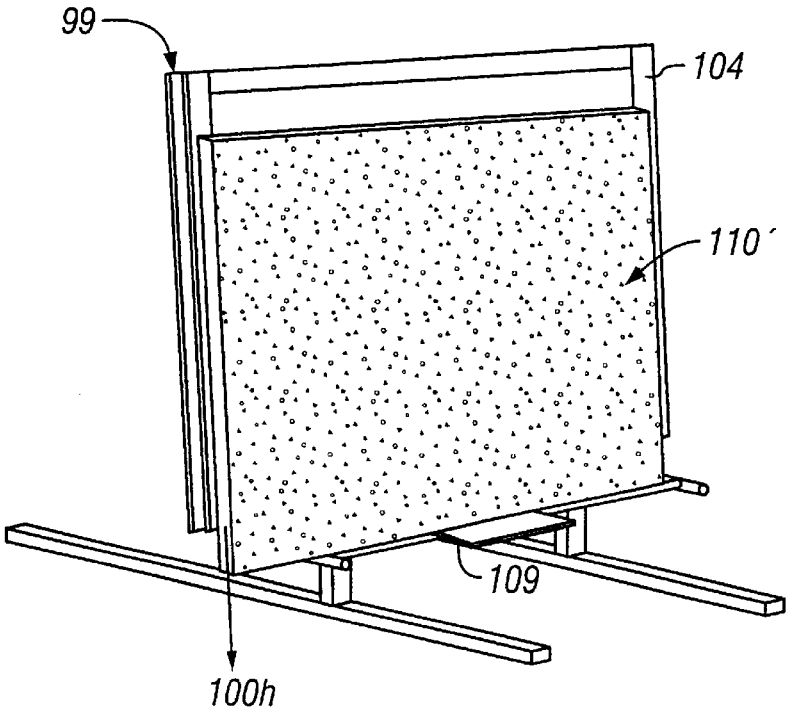
FIG. 10 is a front perspective view of the frame after the chain link tensioning wires have been severed, a bottom wall of the cavity has been removed, the frame has been pivoted to a vertical orientation, and the concrete panel has slid slightly downwardly onto a stop surface.

In reference to FIGS. 8–10, concrete 110 has been poured and smoothed out. As seen in the broken away section of this concrete, items associated with the chain link mesh 101*a* are embedded inside the concrete. Bar molds 106*e* have been placed on the wet concrete after the finish work has been done. The purpose of these bar molds 106*e* is to leave a quarter circle imprint 111 at the outer surface edge of two sides of the cast concrete panel 110'. When the concrete has "cured" the 106*e* bar molds are stripped away from the panel 110.

Figure 11:
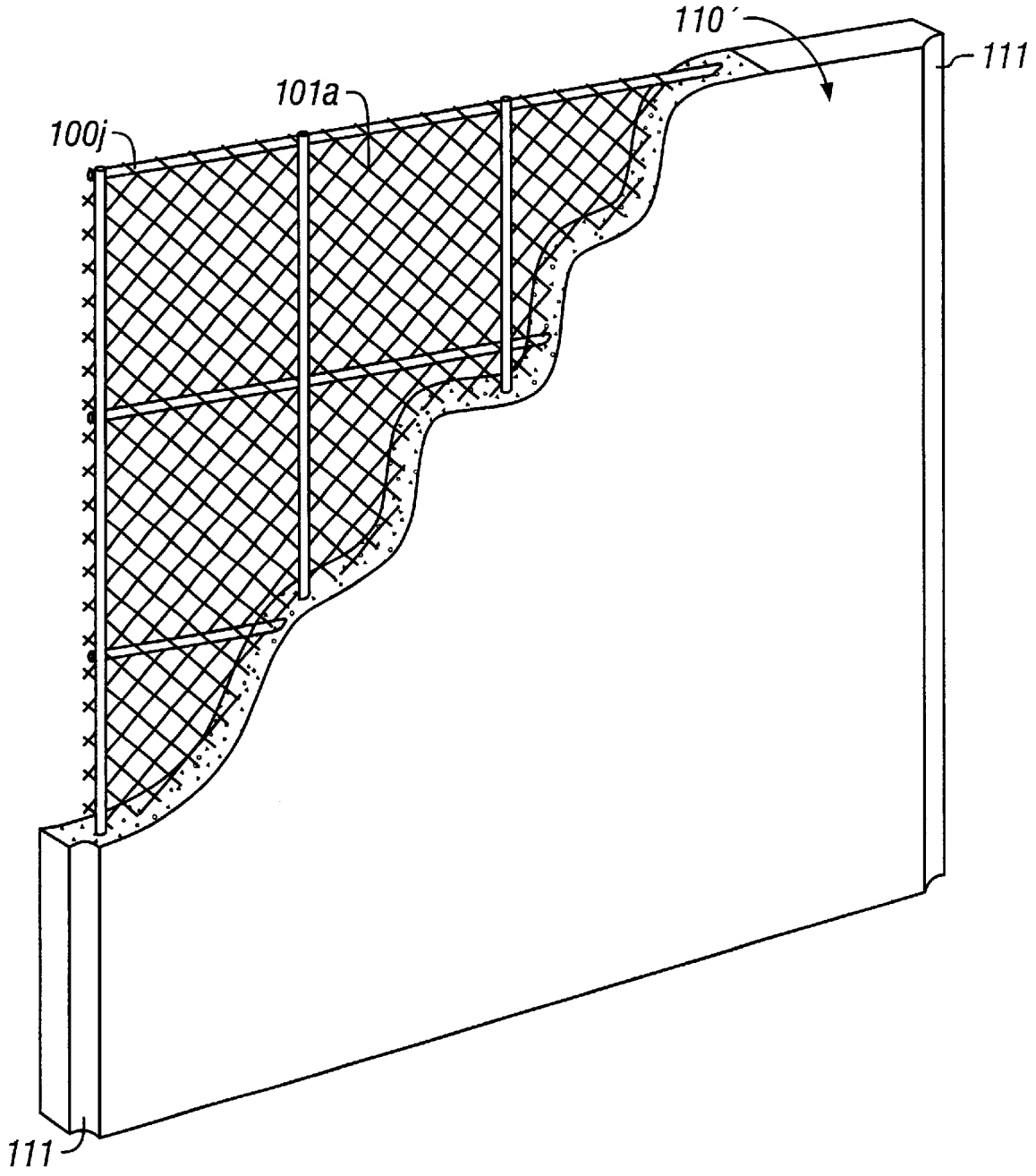
FIG. 11 is a front perspective view of a finished reinforced concrete panel according to the invention, with a portion of the panel broken away to reveal the reinforcement.

Then, the tie wires 101*b* and 101*b*' are cut loose, and the sections 106*d*, 106*a*, 106*c* and 100*b* of the frame 104 are removed (FIG. 10). Referring to FIG. 10, the casting platform 99 has been tilted up, and the concrete panel 110' is allowed to slide down in direction 100*h* to rest upon the anchor/panel resting stop 109, In reference to FIG. 11 a perspective cutaway view of a finished concrete panel 110' is shown in its upright position with the woven chain link mesh 101*a* under tension, and bound by the concrete.

That panel 110' is uniquely strong and can be used in the fabrication of highly durable buildings or flood dykes, or, as will be described below, as an earth reinforcement wall.

Earth Reinforcement Wall

Figure 12A:
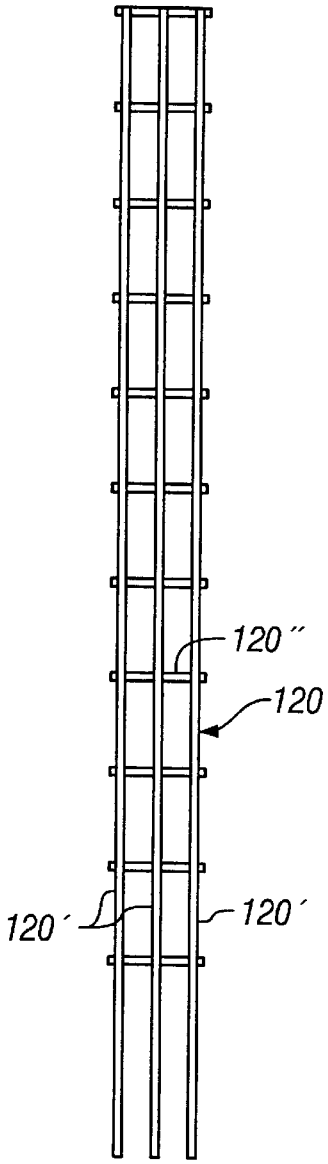
FIG. 12A is a side elevational view of a first type of framework.
Figure 12B:
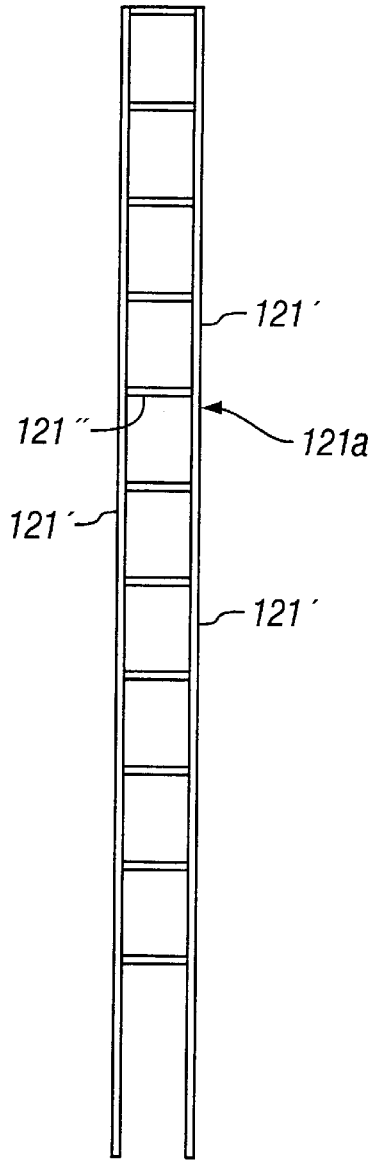
FIG. 12B is a side elevational view of a second type of framework.

Meanwhile, in FIG. 12A, three vertical sections of rebar 120' have been welded to horizontal sections of rebar 120" to form a skeletal framework 120 that is to be used in fabricating the earth reinforcing wall. In FIG. 12B, two vertical sections of rebar 121' have been welded to horizontal rebar sections 121" to form a skeletal framework 121*a*.

Figure 12C:
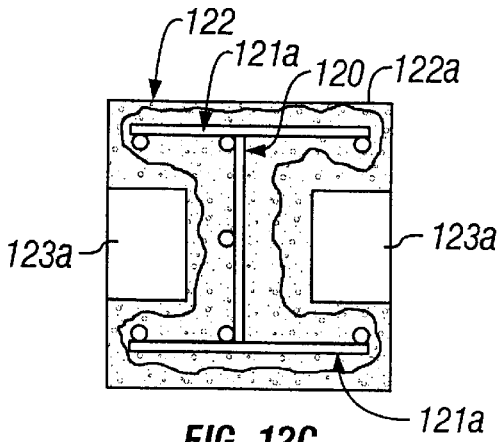
FIG. 12C is a top plan view of a concrete post in which the frameworks of FIGS. 12A and 12B are disposed as reinforcement.
Figure 13:
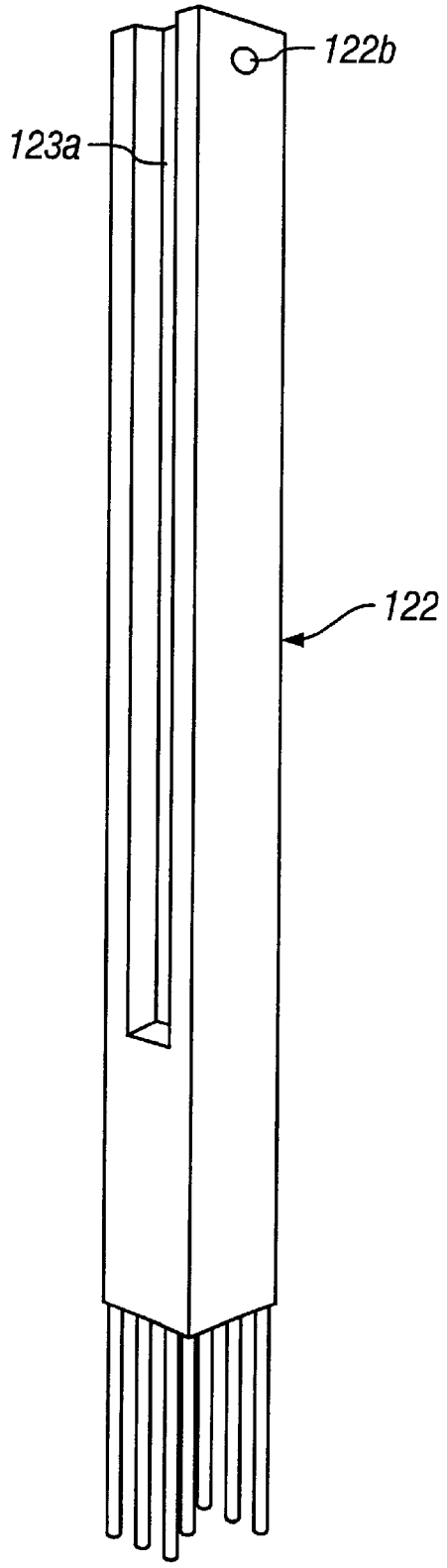
FIG. 13 is a front perspective view of the post depicted in FIG. 12C.

In FIG. 12C, the completed framework 120, and two of the completed frameworks 121*a* have been welded together to form a matrix which is embedded in concrete 122*a* to form a post 122. Two slots 123*a* formed in the post 122 constitute rest stops aw will be described (see FIG. 13). The post 122 includes a hole 122*b* at its upper end which goes from one side of the post to the other.

Figure 14:
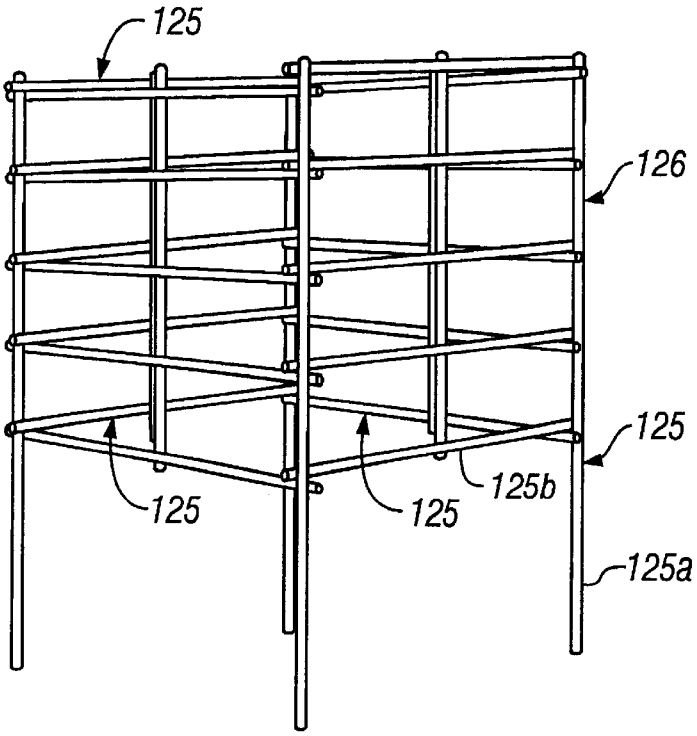
FIG. 14 is a front perspective view of a framework.

In FIG. 14 there are shown four skeletal frameworks 125 each formed of vertical rebars 125*a* and horizontal rebars 125*b*. The four frameworks 125 have been welded together to form a unit 126 hereinafter called a marriage band.

Figure 15:
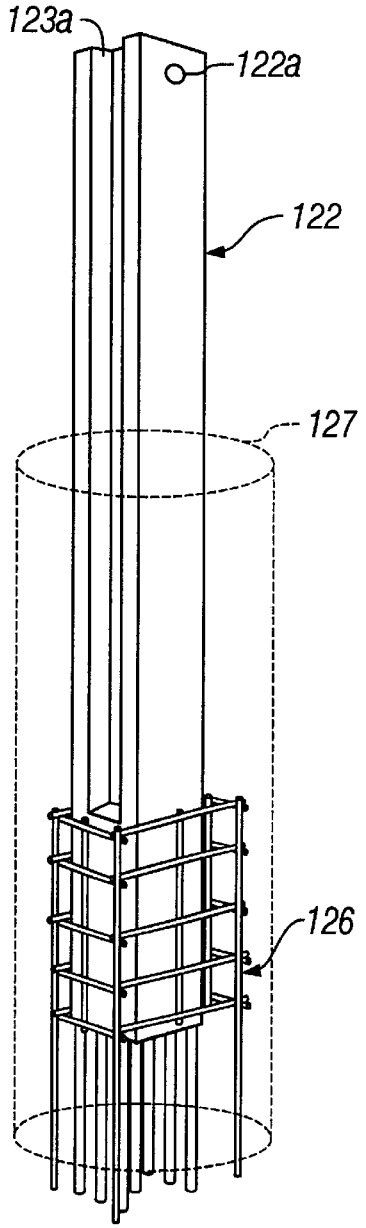
FIG. 15 is a front perspective view of the post of FIG. 13 disposed in the ground, and with the framework of FIG. 14 inserted downwardly around the post.

FIG. 15 shows how the marriage band 126 is to be combined with the post 122 in a vertical hole 127 formed in the ground, as will be explained subsequently.

Figure 16:
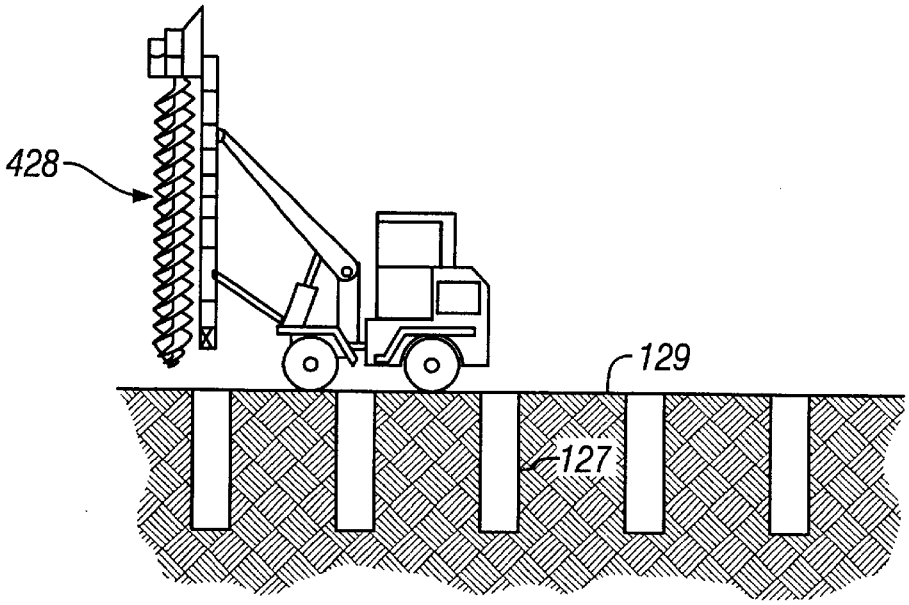
FIG. 16 is a perspective view of vertical holes being drilled into the ground.

In reference to FIG. 16, there is shown a conventional tractor-mounted drilling unit 428 traveling along the ground surface 129 drilling the holes 127 to a predetermined depth, at a predetermined distance apart. The holes 127 are sized to accommodate the concrete posts 122 and the marriage bands 126 shown in FIG. 15.

Figure 17:
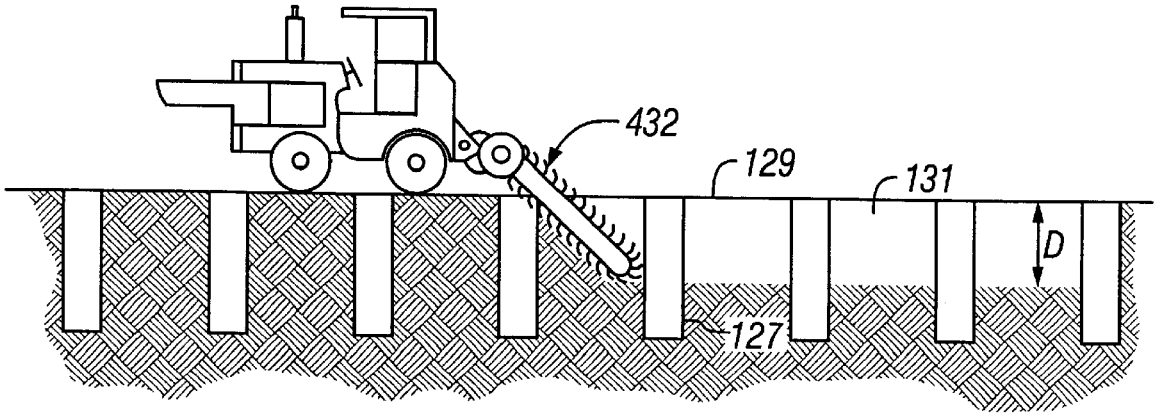
FIG. 17 is a view similar to FIG. 16 as a trench is being dug into the ground in intersecting relationship to the holes.
Figure 18:
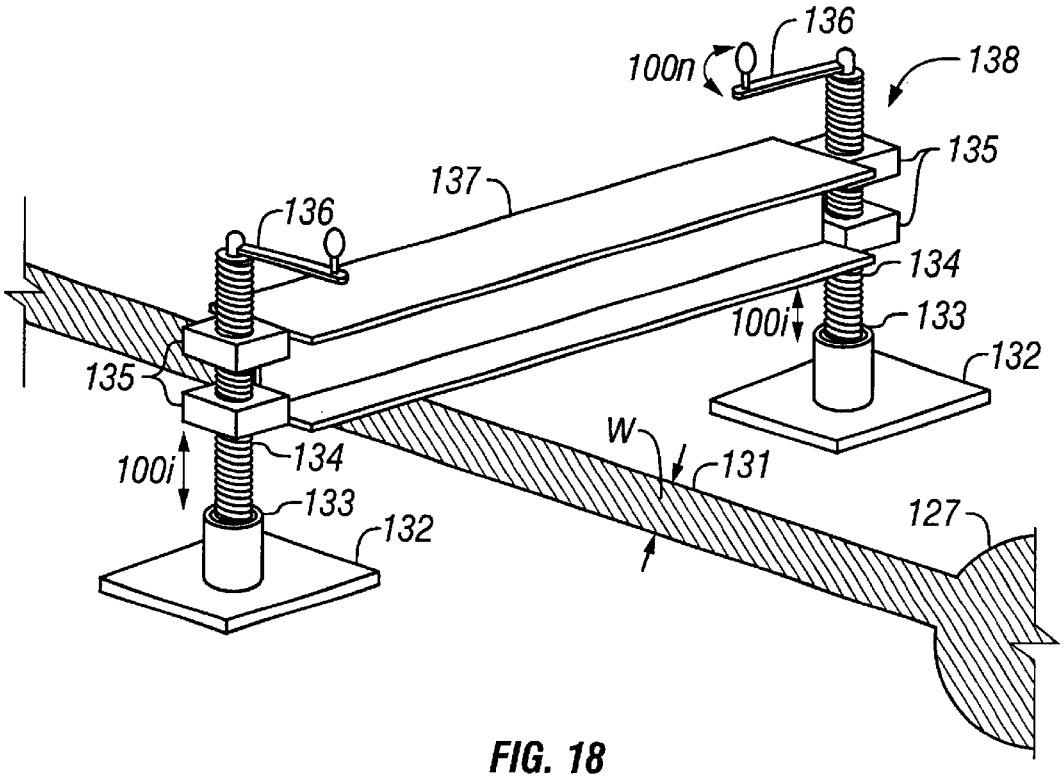
FIG. 18 is a front perspective view of a stand adapted to support a post holding template, the stand being erected over the trench.

In reference to FIG. 17 and 18, there is shown a tractor mounted trenching unit 432 traveling along the surface 129 digging a trench 131 to a predetermined width W and depth D through the previously drilled holes 127.

In reference to FIG. 18 a perspective view of a template rack stand 138 is viewed straddling the trench 131. The stand 138 includes base plates 132 resting stationarily on the ground at predetermined positions. A cylindrical piece of cut tubing 133 is welded to each base plate 132. The inside void of each tube 133 accommodates, and maintains, the vertical position of a threaded rod 134 which is capable of rotating freely within the confines of the tube 133. Steel blocks 135 having a threaded passageway in the center are welded to an end of a steel I beam 137. A handcrank 136 is attached to the top of the threaded rod 134. Turning of the handcrank 136 will cause rods 134 to turn in the same direction and, depending on the direction of rotation, cause blocks 135 to travel up or down.

Figure 19A:
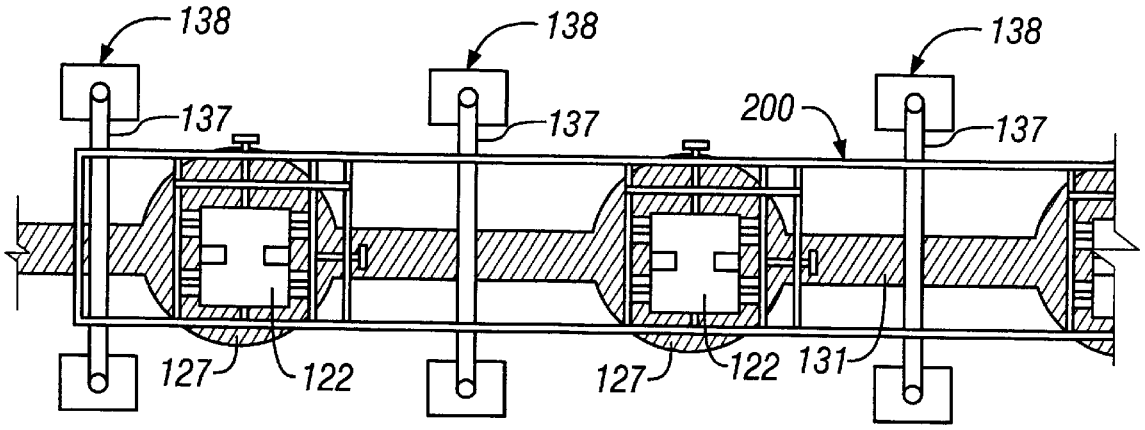
FIG. 19A is a top plan view of a template rack that is supported on a plurality of the stands depicted in FIG. 18.
Figure 19B:
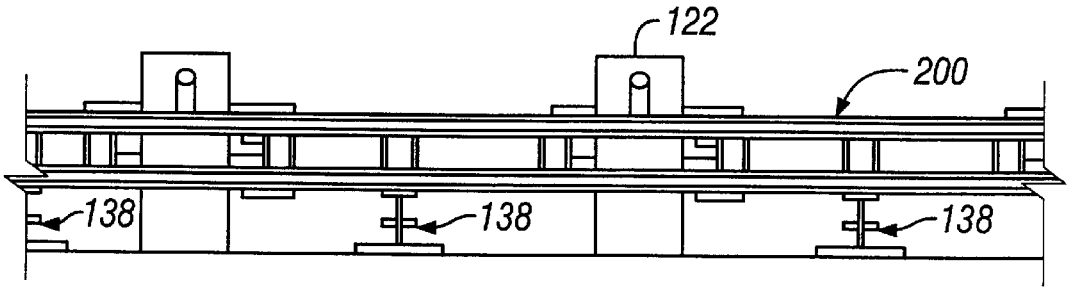
FIG. 19B is a front elevational view of the arrangement depicted in FIG. 19A.

A plurality of stands 138 is provided to hold a post holding template rack 200, as shown in FIGS. 19*a*, 19*b*. The template rack 200 has two identical vertically spaced support levels, one of which being depicted in FIG. 20.

Figure 20A:
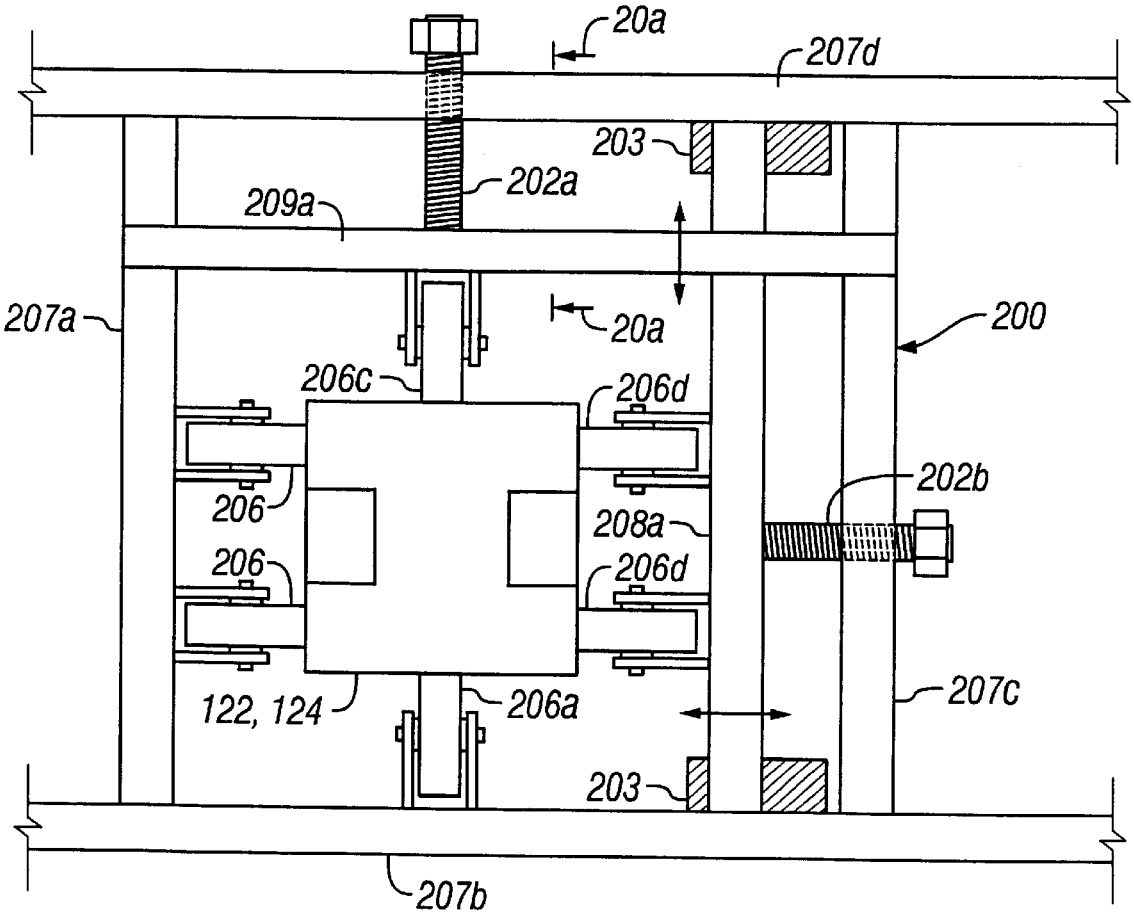
FIG. 20A is a perspective view depicting a manner of adjusting support rollers of the template.
Figure 20B:
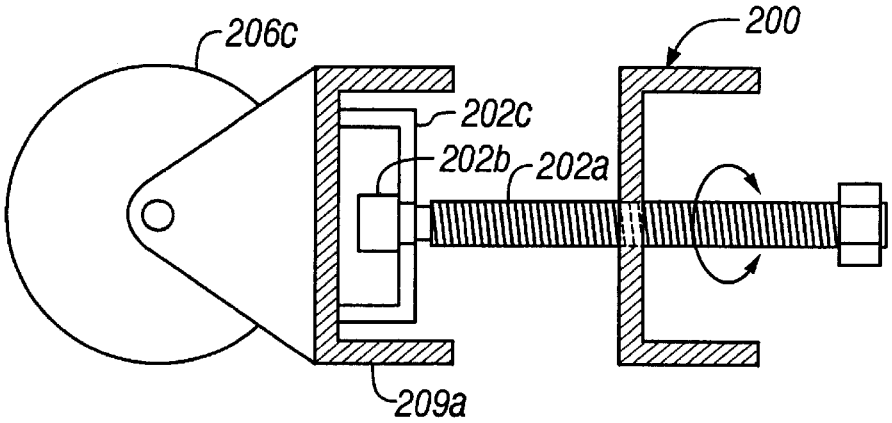
FIG. 20 is a top plan view depicting the post of FIG. 13 being lowered through the template and into one of the holes shown in FIG. 17.

FIG. 20 depicts from above, a post holding template rack 200 which includes stationary members 207*a*, 207*b*, 207*c*, 207*d*. The member 207*a* carries two rollers 206 which will roll, but are incapable of back and forth travel. The same is true of roller 206*a* attached to the member 207*b*. Mobile members 209*a*, and 208*a* carry rollers 206*c*, 206*d*. The members 209*a*, 208*a* are able to be slid back or forth in the direction of the respective arrows, depending on which direction a respective threaded rod 202*a*, 202*b* passing through the main framework 200 is turned. Member 208*a* rests upon a piece of plate steel 203 welded to the bottom of the main framework 200. Member 209*a* rests atop members 207*a*, 208*a*, and 207*c*.

These resting places allow units 209*a*, and 208*a* to remain in a fixed horizontal plane and be pressed firmly in their respective directions of travel against a post 122 or 124. An arrangement identical to that shown in FIG. 20 is provided in vertically spaced relationship to that shown in FIG. 20.

Figure 21A:
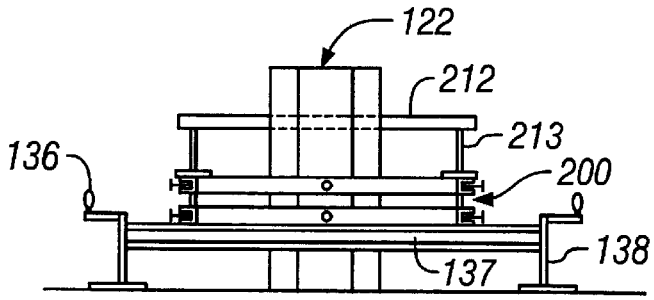
FIG. 21A is a front elevational view of a post holding template with a post projecting therethrough.
Figure 21B:
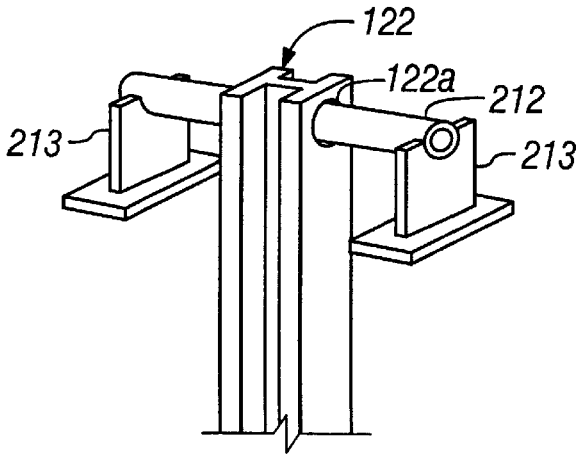
FIG. 21B is a perspective view of an upper end of the post depicted in FIG. 21A.
Figure 22:
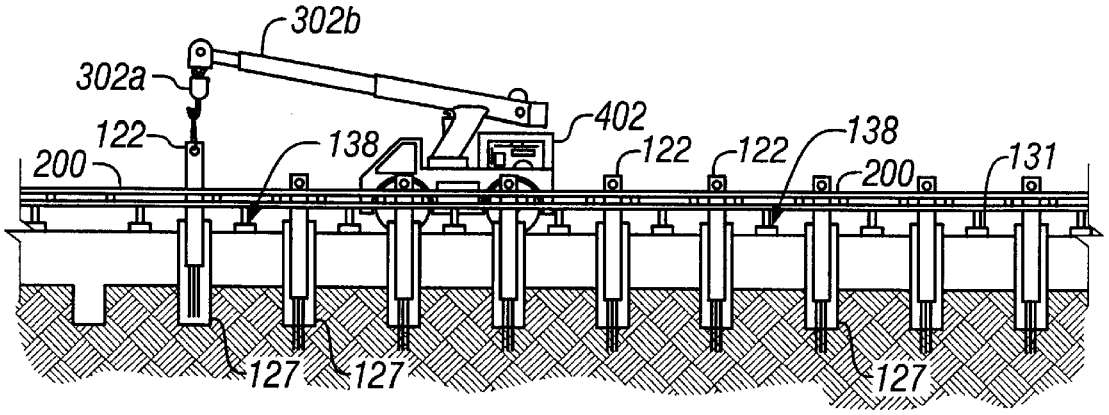
FIG. 22 is a view depicting the posts being lowered through the template.

A plurality of the posts 122 are brought by a suitable transport vehicle 402 to the template rack 200, as shown in FIG. 22. Each post is lowered downwardly through the template rack 200 and into a respective hole 127. Base members 213 are supported atop the template rack 200 (see FIGS. 21A, 21B), and a pipe 212 is inserted through the hole 122*a* formed in the upper end of the post 122. Ends of the pipe 212 are supported in recesses formed in the base members 213. Thus, the posts are suspended.

A vertical position of the post 122 can be controlled by rotation of the hand cranks 136.

The rollers 206*c*, 206*d* are moved into engagement with the respective posts to maintain the posts in vertical orientations as they are moved downwardly.

Figure 23:
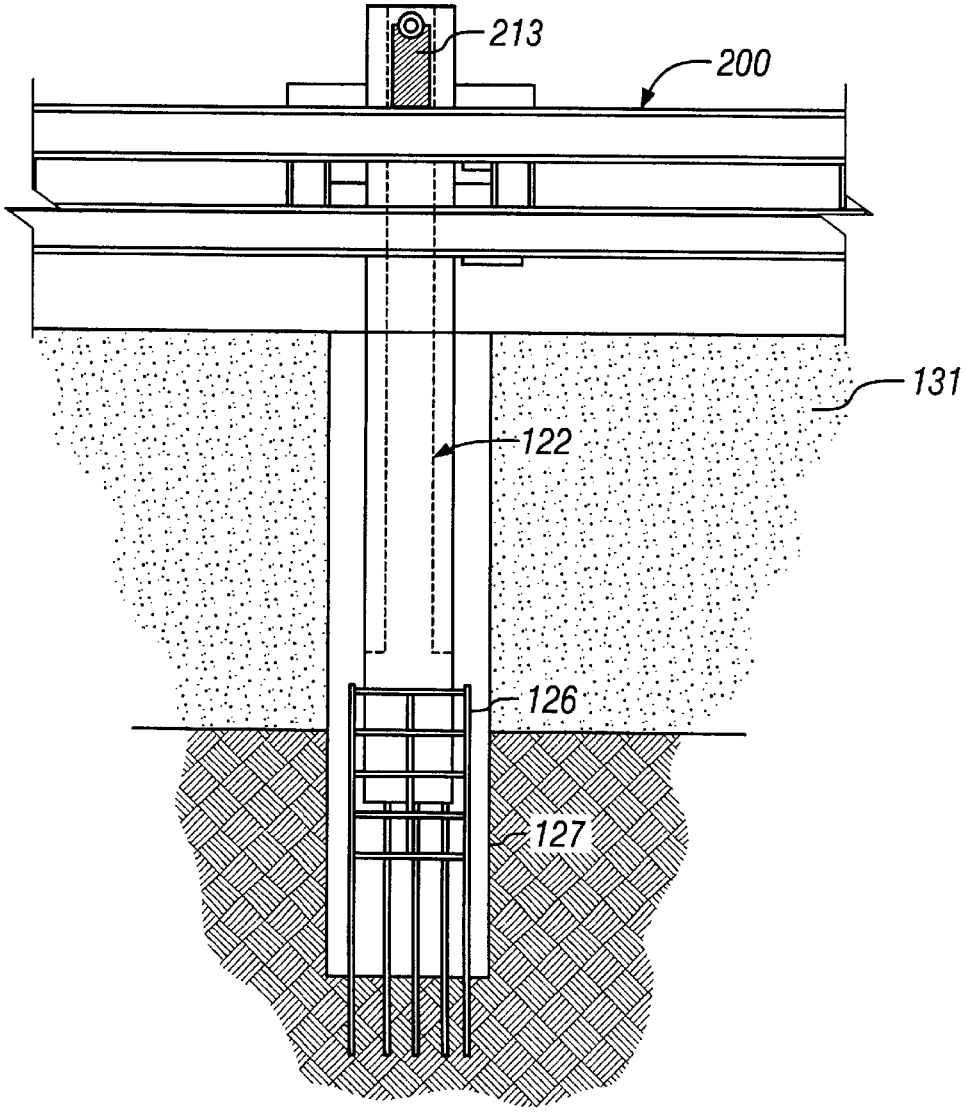
FIG. 23 is a view through the earth depicting the post disposed in one of the holes.

Then, the marriage bands 125 are lowered down around respective posts 122, as shown in FIG. 23.

Figure 24:
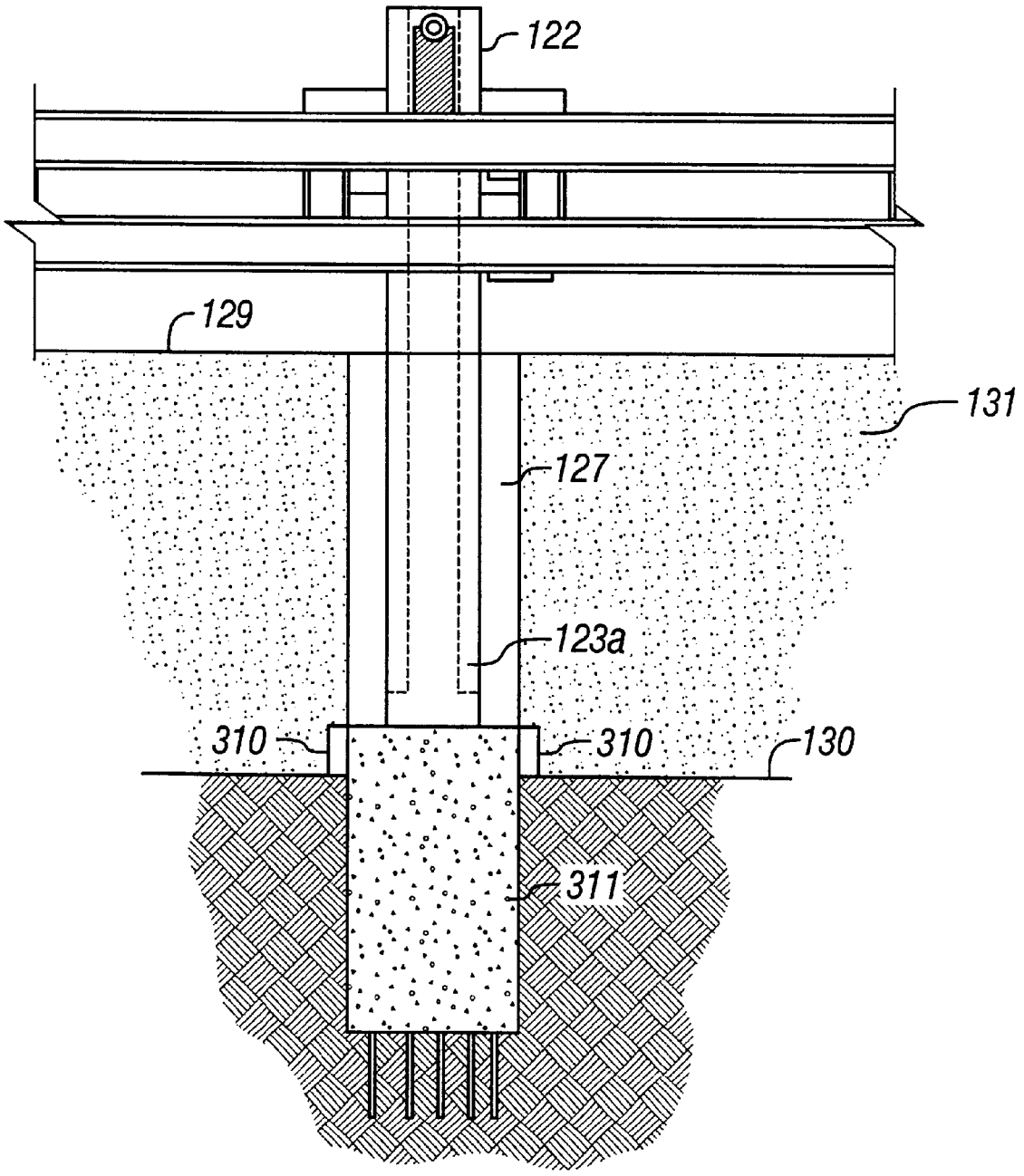
FIG. 24 is a view similar to FIG. 23 after concrete has been inserted into the hole to anchor the post.

Then, as shown in FIG. 24, a concrete base 311 is poured. Pieces of wood 310 were previously installed to act as temporary forms for controlling the shape of the concrete above the level of the holes 127. Then, the forms 310 are removed.

Figure 25:
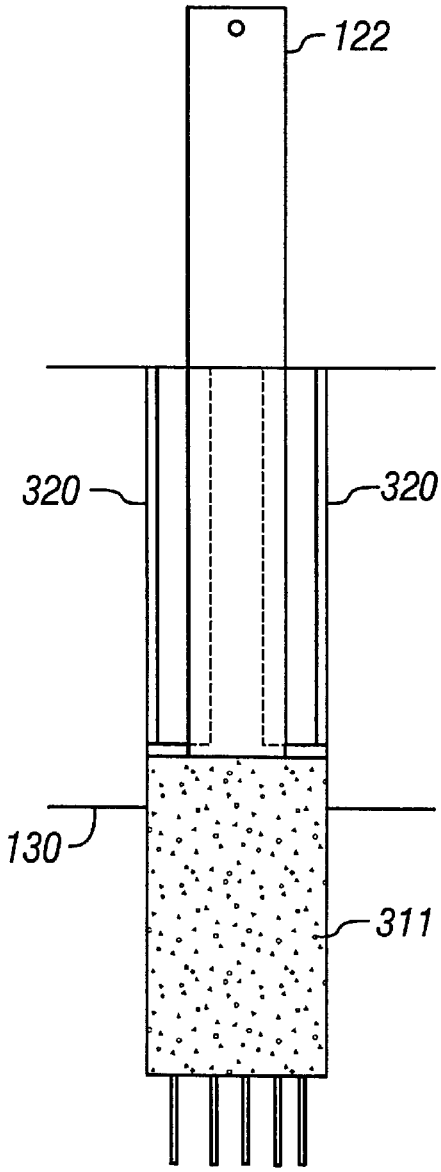
FIG. 25 is a view similar to FIG. 24 after forms have been inserted into an upper portion of the post.
Figure 26:
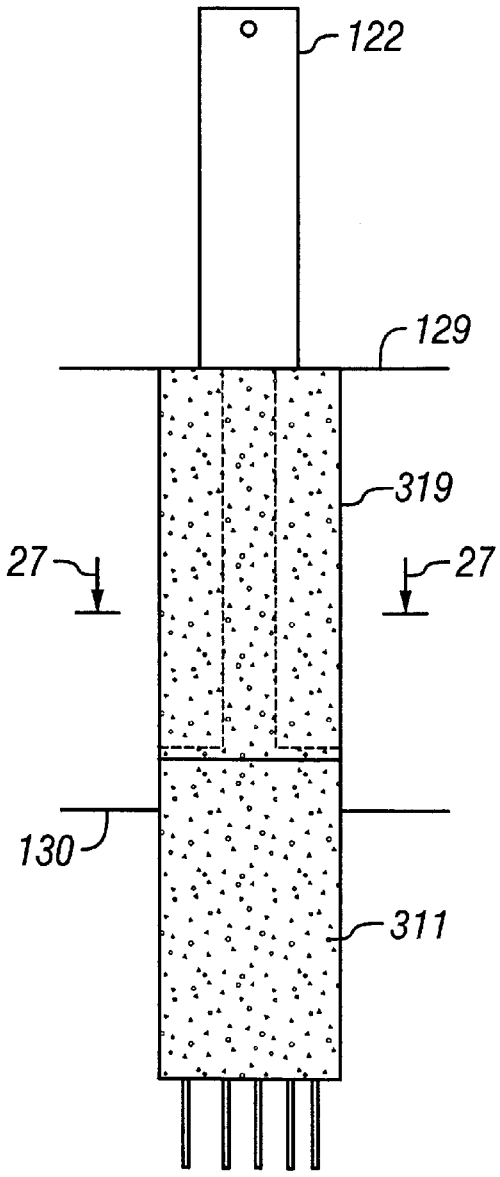
FIG. 26 is a view similar to FIG. 25 after additional concrete has been poured into the trench to fully anchor the post.
Figure 27:
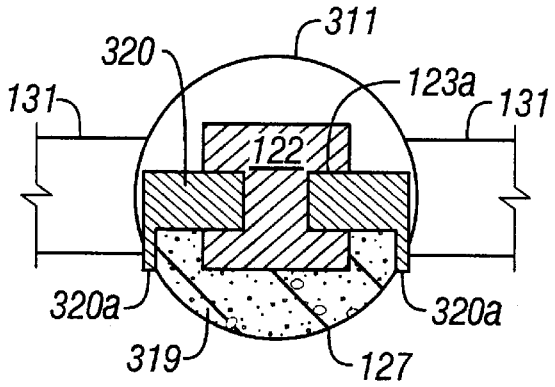
FIG. 27 is a sectional view taken along the line 27—27 in FIG. 26.

Then, forms 320 are positioned within the recesses 123*a* of the post, as shown in FIGS. 25–27. Each form 320 includes a portion extending into a respective recess 123*a*, and a portion 320*a* engaging a side of the trench 131, whereby a space is formed between the trench 131, the post 122, and the forms 320. Concrete 319 is then poured into that space as shown in FIGS. 26 and 27. Then, the forms 320 are removed.

Figure 28:
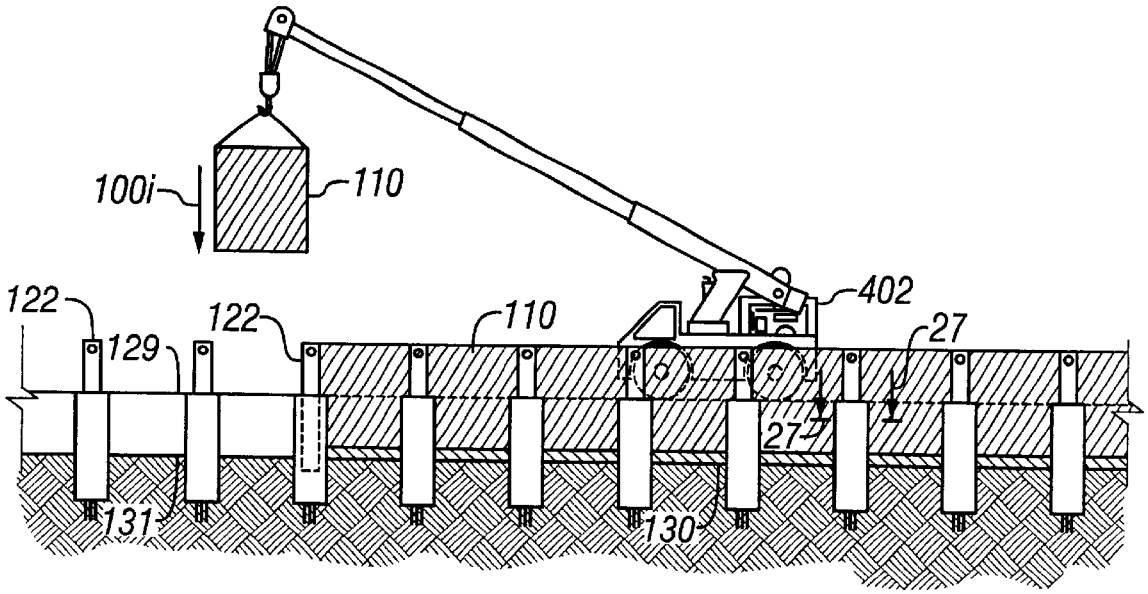
FIG. 28 is a view showing panels of the type depicted in FIG. 11 being lowered into the trench.
Figure 29:
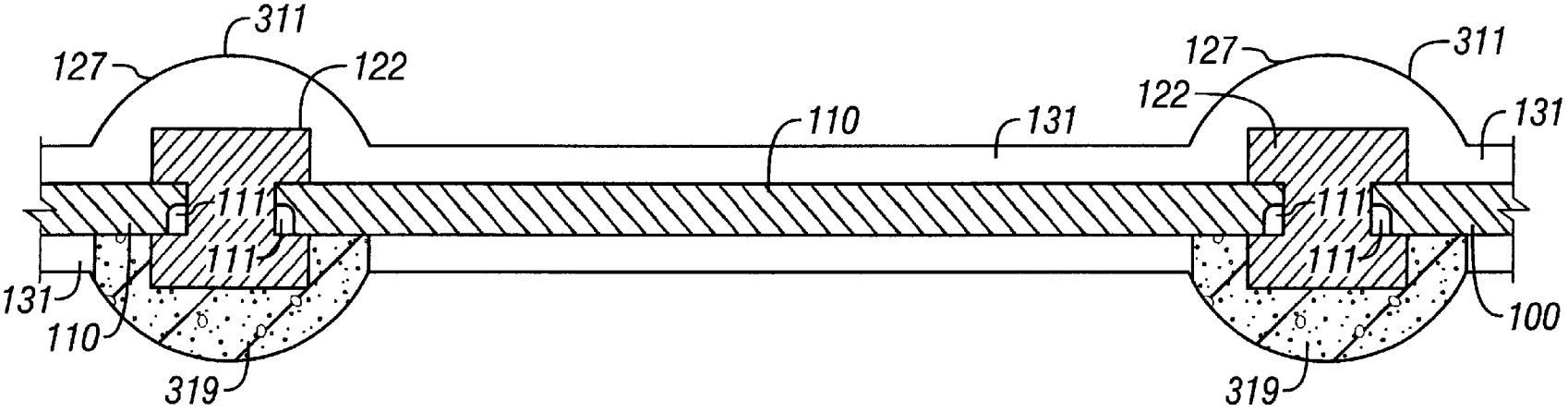
FIG. 29 is a top plan view of FIG. 29 depicting panels arranged in tongue-and-socket connection with adjacent ones of the posts.

A vehicle 402 then brings previously-described reinforced concrete panels 110' and lowers them such that opposite vertical edges thereof enter the recesses 123 of adjacent ones of the posts 122, as shown in FIGS. 28 and 29. Thus, the posts 122 constitute panel retaining members. The panels 110' descend until coming to rest on the bottom 130 of the trench 131.

Figure 30:
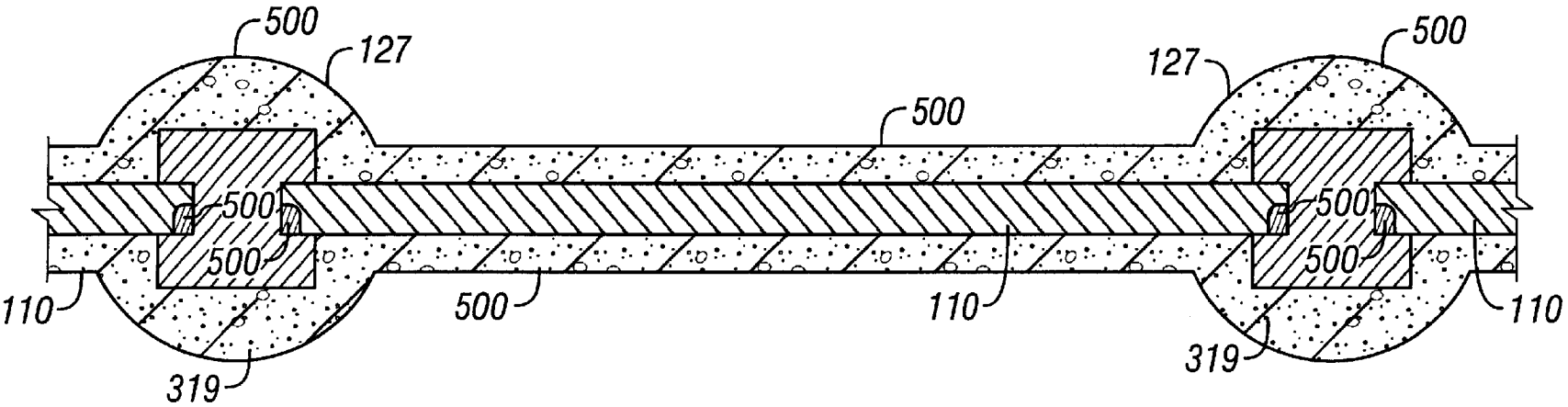
FIG. 30 is a view similar to FIG. 29 after additional concrete has been poured into the trench.

Then, the rest of the holes 127 and trench 131 is filled with concrete 319 to completely embed the panel, as shown in FIG. 30. The quarter-circle voids 111 formed in the panel have also been filled with concrete 319.

It will be appreciated that modifications are possible within the scope of the invention. For example, the method of inserting the marriage band 126 into the ground (FIG. 23) depends upon the ground being relatively soft. If, on the other hand the ground is hard, then the holes 127 would not be drilled; only the trench 131 would be dug. The posts 122 would be provided with pointed bottoms and would be hammered into the ground within the trench 131 in order to become anchored. No marriage bands would be used.

Figure 31:
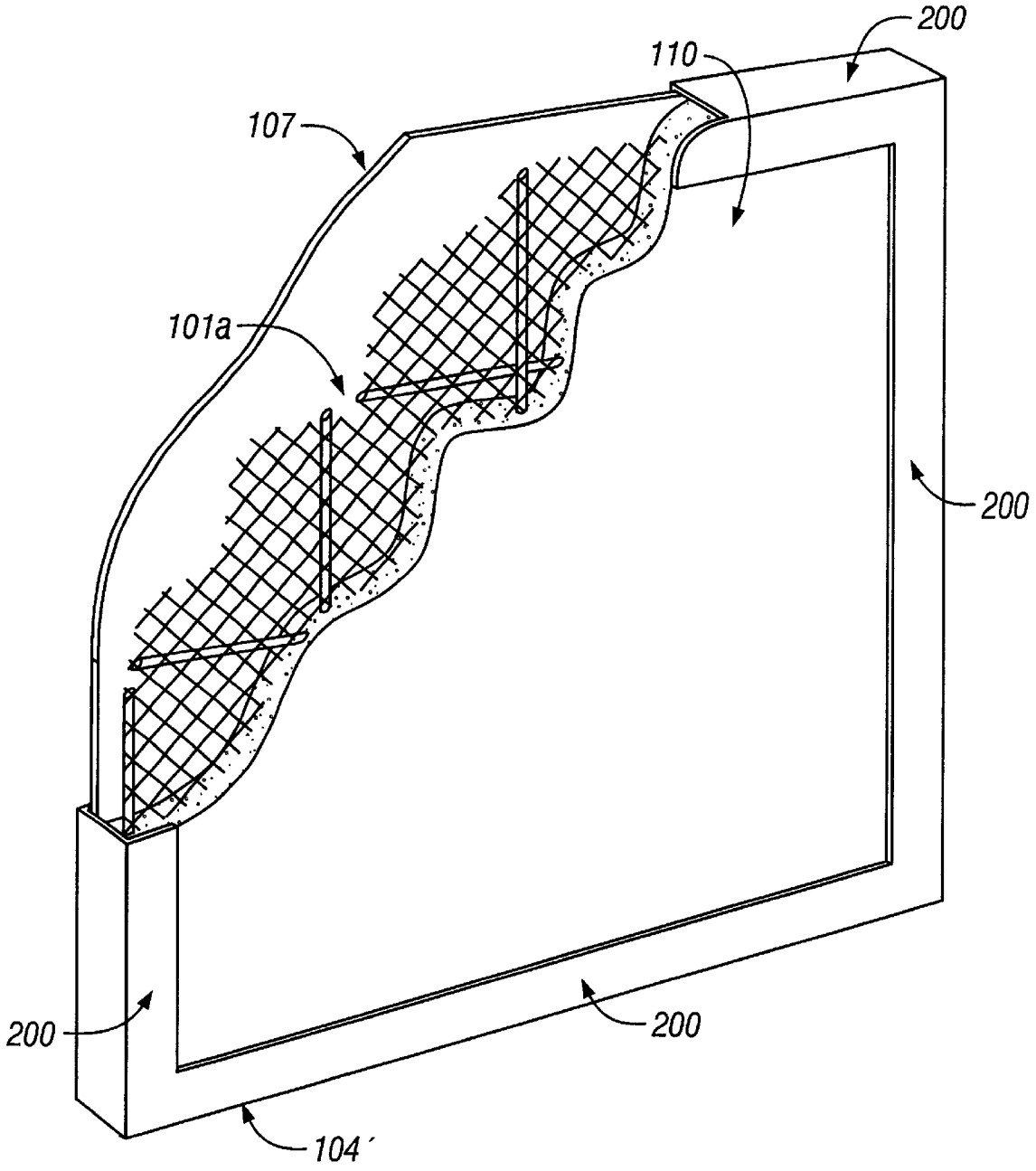
FIG. 31 is a perspective view of an alternative form of frame for forming a reinforced panel, with a portion of the frame being broken away to reveal the panel.

Also, the frame 104' which forms the cavity in which the concrete panel 110' is fabricated could alternatively be formed by elements 200 having a U-shaped cross section, as shown in FIG. 31. The elements 200 are welded together, and the elements and the backing plate 107*b*, form part of the finished reinforced panel, along with the concrete and the chain link unit 101*a*.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A reinforced structural concrete panel comprising a concrete body having a pre-tensioned metallic chain link mesh unit embedded therein, the chain link mesh unit extending across a substantial portion of the concrete body, the chain link mesh unit comprising a plurality of zig-zag shaped strands, each strand comprising a plurality of substantially parallel first segments and a plurality of substantially parallel second segments, the first segments oriented substantially perpendicular to the second segments, each first segment forming an apex with an adjacent second segment, the strands arranged in side-by-side relationship with the apexes of each strand interlinked with respective apexes of an adjacent strand, wherein the interlinked apexes form parallel rows of interlinked apexes, the rows extending substantially perpendicular to the strands, the mesh unit being prestressed in a direction substantially perpendicular to the strands and substantially parallel to the rows of interlinked apexes.

2. The reinforced structural panel according to claim 1 wherein the chain link mesh unit comprises steel.

3. The reinforced structural panel according to claim 1 wherein the panel is of substantially rectangular shape.

4. The reinforced structural unit according to claim 3 wherein two parallel corners of the panel include respective quarter-circle recesses formed therein.

5. The reinforced structural concrete panel according to claim 1, further including linear tension bars extending through respective ones of the strands which define opposite side edges of the mesh unit, each linear tension bar passing through the apexes of its respective strand.

6. A method of forming a reinforced structural concrete panel comprising the steps of:

A) positioning a metallic chain link mesh unit in a cavity formed by a frame, the chain link mesh unit comprising a plurality of zig-zag shaped strands, each strand comprising a plurality of substantially parallel first segments and a plurality of substantially parallel second segments, the first segments oriented substantially perpendicular to the second segments, each first segment forming an apex with an adjacent second segment, the strands arranged in side-by-side relationship with the apexes of each strand interlinked with respective apexes of an adjacent strand, wherein the interlinked apexes form parallel rows of interlinked apexes, the rows extending substantially perpendicular to the strands and substantially parallel to the rows of interlinked apexes;

B) applying tensioning forces to the chain link mesh unit in a direction substantially perpendicular to the strands and substantially parallel to the rows of interlinked apexes for stretching and pre-tensioning the chain link mesh unit;

C) pouring concrete into the cavity while maintaining the chain link mesh unit in a pre-tensioned state, to embed the chain link mesh unit in the concrete;

D) allowing the concrete to harden; and

E) releasing the tensioning forces from the chain link mesh unit, wherein the interlinked joints maintain the strands in a pre-tensioned state in the hardened concrete.

7. The method according to claim 6 wherein at least steps C and D are performed while the cavity and chain link mesh unit are oriented horizontally, and including the further step of rotating the frame about a horizontal axis for raising the panel to a vertical state subsequent to step D.

8. The method according to claim 6 wherein step B comprises engaging the chain link mesh unit with fingers of a stretching member and rotating a shaft that is threadedly connected to the stretching member to cause one end of the chain link mesh unit to be displaced while holding an opposite end thereof stationary.

9. The method according to claim 8 wherein the opposite end of the chain link mesh unit is held stationary by extending wires through respective holes in the frame and attaching one end of each wire to the chain link mesh unit and another end thereof to a stationary member situated outside of the cavity.

10. The method according to claim 6 wherein step B further comprises inserting linear tension bars into strands that define opposite side edges of the chain link mesh unit, the tension bars extending through the apexes of the respective strands, and applying the tensioning forces to the tension bars; and step C including embedding the tension bars in the concrete.

11. A method of forming an earth retaining wall comprising the steps of:

A) digging a trench in the ground;

B) anchoring panel-retaining members in the trench, the panel-retaining members projecting below a bottom of the trench;

C) lowering reinforced concrete panels into the trench between respective pairs of panel-retaining members such that opposite vertical edges of each panel become connected to the respective pair of panel-retaining members by a tongue-and-socket coupling, the panel-retaining members projecting below the panels; and D) pouring concrete into the trench to embed the panels and the panel-retaining members therein.

12. The method according to claim 11 further including making the reinforced concrete panel by the steps of:

A) positioning a metallic chain link mesh unit in a cavity formed by a frame;

B) applying tensioning forces to the chain link mesh unit for stretching and pre-tensioning the chain link mesh unit;

C) pouring concrete into the cavity while maintaining the chain link mesh unit in a pre-tensioned state, to embed the chain link mesh unit in the concrete;

D) allowing the concrete to harden; and

E) releasing the tensioning forces from the chain link mesh unit.

13. The method according to claim 11 further including, prior to step A, the step of digging vertical holes in the ground, with centers thereof lying on a common line, step A being performed such that the trench is dug along the common line to intersect the holes, the trench being shallower than the holes, step B being performed by anchoring the panel-retaining members in respective ones of the holes.

14. The method according to claim 13 wherein a lower portion of each panel-retaining member is embedded in the ground beneath the respective hole.

15. The method according to claim 11 wherein step C comprises lowering each panel such that vertical edges thereof slide downwardly within vertical slots formed in respective panel-retaining members to form the tongue-and-groove coupling.

* * * * *